US006662995B1

(12) United States Patent
Mori

(10) Patent No.: US 6,662,995 B1
(45) Date of Patent: Dec. 16, 2003

(54) ENVELOPE AND FOLDABLE ENVELOPE SHEET

(76) Inventor: Shohei Mori, 7-4, Takaramachi, Komatsu, Ishikawa 923-0803 (JP)

( * ) Notice: Subject to any disclaimer, the term of this patent is extended or adjusted under 35 U.S.C. 154(b) by 0 days.

(21) Appl. No.: 09/868,591

(22) PCT Filed: Oct. 20, 2000

(86) PCT No.: PCT/JP00/07301

§ 371 (c)(1),
(2), (4) Date: Jun. 20, 2001

(87) PCT Pub. No.: WO01/28878

PCT Pub. Date: Apr. 26, 2001

(30) Foreign Application Priority Data

Oct. 22, 1999 (JP) ..... 11-300667
Mar. 17, 2000 (JP) ..... 2000-75548

(51) Int. Cl.[7] ..... B65D 27/34
(52) U.S. Cl. ..... 229/313; 229/316
(58) Field of Search ..... 229/313, 316, 229/315

(56) References Cited

U.S. PATENT DOCUMENTS 717,993 A * 1/1903 Hinchman ..... 229/313 X
1,306,224 A * 6/1919 Godley ..... 229/313
1,336,646 A * 4/1920 Mendenhall ..... 229/313 X
3,322,329 A * 5/1967 Castanneda et al. ..... 229/316
4,166,538 A * 9/1979 Nixon et al. ..... 229/313
4,607,749 A * 8/1986 Jacob ..... 229/313
5,499,757 A * 3/1996 Back ..... 229/313

FOREIGN PATENT DOCUMENTS

GB 00021000 * 1/1909 ..... 229/313
JP 404142254 A * 5/1992 ..... 229/313
NL 8801784 * 2/1990 ..... 229/313

* cited by examiner

*Primary Examiner*—Jes F. Pascua
(74) *Attorney, Agent, or Firm*—Rabin & Berdo, PC

(57) ABSTRACT

An envelope is recognized from its appearance as an envelope not provided with perforations and is easy and infallible to open without use of a cutting tool, such as scissors. In an envelop (F1) with an opening-side flap (15) folded to cover an opening (8), perforations (M1) are formed along the opening (8), and an adhesive part (10A) for sealing is formed in the vicinity of the perforations (M1) to adhere the opening-side flap (15) to the back wall of the envelope. The opening-side flap (15) is folded and adhered so as to cover the perforations (M1).

13 Claims, 16 Drawing Sheets

F7

F 1

F 1

F 1 a

F 2

F 3

F 3

F 4

F 4

F7

F 8

F9

F9

ENVELOPE AND FOLDABLE ENVELOPE SHEET

FIELD OF THE INVENTION

The present invention relates to an envelope that is easy and infallible to open and a blank that may be folded to form the envelope.

BACKGROUND ART

A receiver can open an envelope or sealed document by using scissors, a cutter, a paper knife or other kind of cutting tool. However, various envelopes have been disclosed (JU-A 04-19436, JU-A 06-35139, JU Reg. 3011338, and JP-A-10-181749, for example). These are formed with an array of perforations or cut scores at the outer periphery and a gripping tab at the end of the envelope so as to enable opening without use of a cutting tool such as scissors. In an ordinary envelope that is not formed with an array of perforations or cut scores, when the closure flap folded to close an opening of the envelope is pinched at the outer peripheral end between the fingers to open the envelope, it is prone to partial tearing. This generally requires a receiver to use a cutting tool such as scissors to open the envelope.

In an envelope, having formed at its periphery, an array of perforations or cut scores, there is a possibility of part of the envelope being cut off at the array of perforations or cut scores during the delivery to expose the enclosed contents. Furthermore, the envelope looks poor in the presence of perforations or cut scores that are conspicuous for a receiver and is therefore not preferable from the standpoint of appearance. What is worse, further, there is a possibility of the envelope being torn open or cut open during mailing. When the perforations or cut scores have a large size, there is a possibility of water, such as rainwater, entering the envelope via the perforations or cut scores to dirty the contents in the envelope.

In general, mail treatment at a post office is mechanically conducted. In treating envelopes formed at the periphery with perforations or cut scores, there is a possibility of a machine catching the perforations or cut scores depending on the size, pitch, etc. of the perforations or cut scores. This makes it impossible to mechanically treat the envelopes due to paper clogging that results in the machine being out of order.

For this reason, "a research meeting on the shape etc. of mail that is difficult to mechanically treat" has started functioning. Researches have been made in determining the standards of the shape etc. of mail that can be mechanically treated and in setting the determination methods. Nowadays, it has been provided "a guideline related to mechanically treatable mail (first-class and second-class mail)." According to the guideline, in the case of envelopes provided at each side with an array of perforations or cut scores (envelopes for mail of not more than 25 g), for example, the positions of the arrays are required to be at one of the short sides of an envelope. In addition, the perforations or cut scores in the arrays are required to have a length not exceeding 2 mm and the uncut portions in the arrays to have a length not exceeding 1 mm. Furthermore, attention has to be paid to the contents to be inserted into an envelope so as not to have steps that would give any stress to the arrays of perforations or score holes. Moreover, in the case of mail having a weight exceeding 25 g but no more than 50 g, a single array has to be formed at one short side of an envelope distant from the face value printing surface thereof. In the case of a zipper type mail, the position is limited to the lower short side of an envelope.

Generally, the opening of an envelope on the side of the closure flap is utilized in sealing the envelope with the closure flap after insertion of the contents and in opening the envelope to take the contents out of the envelope. However, the perforations or cut scores of conventional envelopes are formed on the side of the closure flap. This has sometimes brought about the case where the perforations or cut scores are damaged when sealing the closure flap and the case where good adhesion cannot be obtained when adhering the closure flap to the envelope with an adhesive.

In view of the above, the first object of the present invention is to provide an envelope formed with perforations that is not discernible from outside, and that is easy and infallible to open. The second object thereof is to provide an envelope that is not formed with perforations, but is capable of being opened in the same manner as envelopes formed with perforations. The third object thereof is to provide a blank that may be folded to form each of the envelopes aimed at.

DISCLOSURE OF THE INVENTION

In one aspect, an envelope according to the present invention comprises an opening-side flap folded back to close an envelope opening and adhered to an opening-side wall of the envelope with an adhesive, and is characterized by an array of perforations that is formed along the opening for use in opening the envelope and is covered with the flap that has been adhered. According to the envelope of this invention, when a receiver pinches the peripheral side end of the flap with his/her fingers and intends to open the envelope, the sealed adhesive part of the adhered flap pulls the array of perforations up. This results in clear-cut cutting along the array without leaving the flap remaining. Since the perforation array is covered with the adhered flap, it is not discernible from outside. This envelope looks like the one formed with no perforation and has no possibility of water, such as rainwater, entering it. It is noted that how to open this envelope is the same as the way to open an envelope formed with no perforation. This envelope is not fragile in spite of the presence of the array of perforations because the array is closed with the flap. When a receiver pinches the peripheral side end of the flap with his/her fingers and intends to open the envelope, the flap pulls the array of perforations up via its sealed adhesive part. This enables clear-cut and infallible cutting along the array. Therefore, it is possible to completely eliminate the possibility of part of the flap being left remaining and the possibility of the contents being damaged. Thus, the receiver can open the envelope without anxiety.

In another aspect, an envelope according to the present invention comprises an opening-side flap folded back to close an envelope opening and adhered to an opening-side wall of the envelope with an adhesive, and is characterized by a plurality of adhesive spots for sealing disposed at predetermined intervals so as to seal a proximal end side of the flap and a plurality of adhesive spots disposed at predetermined locations on a distal end side of the flap for preventing outward spread of the flap. According to the envelope of this invention, when a receiver pinches a predetermined part of an outer peripheral flap with his/her fingers, and pinches a predetermined part of an overlapping sheet with his/her fingers and pulls the parts in opposite directions, the envelope is cut out (split off) at the adhesive spots for sealing disposed at predetermined intervals on the proximal end side of the opening-side flap. Thus, this envelope can be easily and infallibly opened in the same manner as an envelope formed with a perforation array. In addition, since the adhesive spots are formed at predetermined locations on the distal end side of the opening-side flap for preventing outward spread of the opening-side flap, there is no possibility of the opening-side flap being split off during mailing. When the adhesive spots for preventing outward spread of the opening-side flap are disposed at the predetermined locations only, it is possible to pinch with fingernails or fingers the outer peripheral side end of the opening-side flap that is not formed with the adhesive spots. This is convenient in opening the envelope. In addition, a hindrance to the mechanical treatment at a post office (mailing office) that has been encountered by conventional envelopes formed at the periphery with perforations or cut scores can be eliminated.

Still in another aspect, an envelope according to the present invention is characterized in that it comprises at least one outer peripheral flap provided on an outer periphery of a center sheet of the envelope and folded back inward, and an overlapping sheet for overlapping the outer peripheral flap, in that the outer peripheral flap is formed in a lengthwise direction with an array of perforations, and in that the overlapping sheet is overlaid on and adhered to the outer peripheral flap. According to the envelope of this invention, since the outer peripheral flap, that has the perforations, is overlapped by the overlapping sheet, and since the overlapping sheet overlaps the outer peripheral flap with the perforation array, the array is not discernible from outside. This envelope looks like the one formed with no perforation. When a receiver pinches a predetermined part of the outer peripheral flap with his/her fingers, pinches a predetermined part of the overlapping sheet with his/her fingers and pulls the parts in opposite directions, the envelope is cut out along the perforation array formed in the lengthwise direction of the outer peripheral flap. Thus, this envelope can be easily and infallibly opened. In addition, a hindrance to the mechanical treatment at a post office (mailing office) that has been encountered by conventional envelopes formed at the periphery with perforations or cut scores can be eliminated.

Still in another aspect, an envelope according to the present invention is characterized in that the opening-side flap or outer peripheral flap is provided with a plurality of adhesive spots for sealing disposed at predetermined intervals so as to seal a proximal end side of the opening-side flap or outer peripheral flap, and a plurality of adhesive spots disposed at predetermined locations on a distal end side of the opening-side flap or outer peripheral flap for preventing outward spread of the opening-side flap or outer peripheral flap. According to the envelope of this invention, since the adhesive spots for sealing the opening-side flap or outer peripheral flap are disposed at predetermined intervals, the envelope can easily and infallibly be opened. In addition, since the adhesive spots are formed at predetermined locations on the distal end side of the opening-side flap for preventing outward spread of the opening-side flap, there is no possibility of the opening-side flap being split off during mailing. When the adhesive spots for preventing outward spread of the opening-side flap are disposed at the predetermined locations only, it is possible to pinch with fingernails or fingers the outer peripheral side end of the opening-side flap that is not formed with the adhesive spots. This is convenient in opening the envelope.

Yet still in another aspect, an envelope according to the present invention is characterized in that it comprises at least one outer peripheral flap provided on an outer periphery of a center sheet of the envelope and folded back, and an overlapping sheet for overlapping the outer peripheral flap, and in that the overlapping sheet is overlaid on and adhered at predetermined intervals to the outer peripheral flap. According to the envelope of this invention, when a receiver pinches a predetermined part of the outer peripheral flap with his/her fingers, pinches a predetermined part of the overlapping sheet with his/her fingers and pulls the parts in opposite directions, the envelope is cut out (split off) at the parts adhered at the predetermined intervals. Thus, this envelope can be easily and infallibly opened in the same manner as an envelope formed with a perforation array.

Yet still in another aspect, an envelope according to the present invention is characterized in that the overlapping sheet has an outer peripheral end adjacent to the outer peripheral flap and in that the outer peripheral end has a part disposed inward of a fold line of the outer peripheral flap. According to the envelope of this invention, since the outer peripheral end of the overlapping sheet has a part disposed inward of a fold line of the outer peripheral flap, the envelope can be easily and infallibly opened with a hand at a boundary between the outer peripheral flap and the overlapping sheet due to the presence of that part.

Further, a blank folded to form an envelope according to the present invention comprises, in a developed state, at least one outer peripheral flap provided on an outer periphery of a center sheet of the envelope and folded back, and an overlapping sheet for overlapping the outer peripheral flap. The blank is characterized in that the outer peripheral flap is formed in a lengthwise direction with an array of perforations, and in that the overlapping sheet is overlaid on and adhered to the outer peripheral flap. According to the blank of this invention, an envelope provided with the array of perforations and which is easy and infallible to be opened can be formed with ease. That is to say, the envelope can be formed with ease by providing a conventional blank with an array of perforations and as occasion demands by changing the order of folding.

Still further, a blank folded to form an envelope according to the present invention comprises, in a developed state, at least one outer peripheral flap provided on an outer periphery of a center sheet of the envelope and folded back, and an overlapping sheet for overlapping the outer peripheral flap. The blank is characterized in that the overlapping sheet is overlaid on and adhered at predetermined intervals to the outer peripheral flap. According to the blank of this invention, an envelope which is easy and infallible to be opened can be formed with ease in spite of the absence of an array of perforations. That is to say, the envelope can be formed with ease by attaching the outer peripheral flap and overlapping sheet of a conventional blank to each other at predetermined intervals and as occasion demands by changing the order of folding.

BEST MODE FOR EMBODYING THE INVENTION

One embodiment of the present invention will be described in detail hereinafter with reference to the accompanying drawings.

(First Embodiment)

Figure 1:
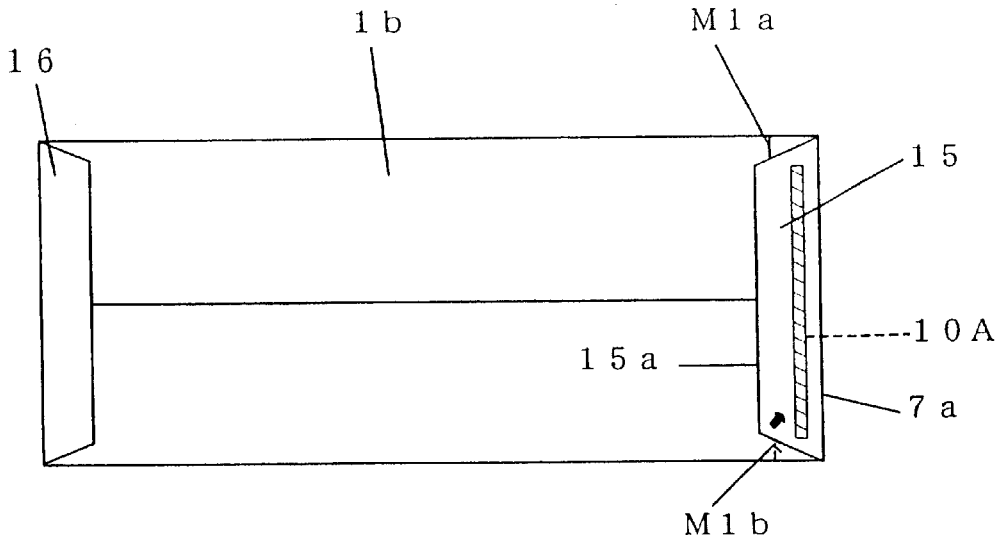
FIG. 1 is a rear view showing an envelope according to the first embodiment of the present invention.
Figure 2:
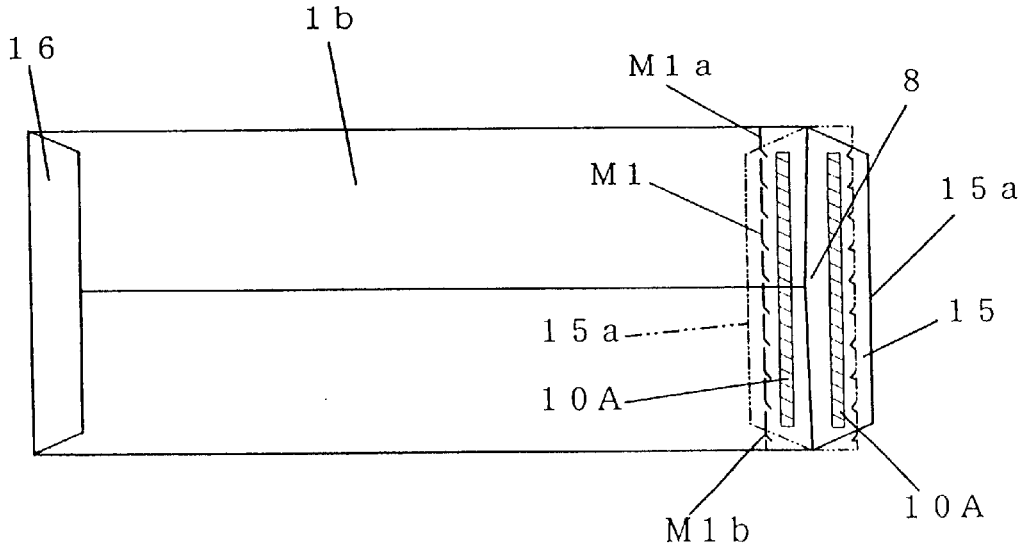
FIG. 2 is a rear view showing the envelope according to the first embodiment, with an opening-side closure flap developed.

As shown in FIG. 1 and FIG. 2, this embodiment applies the present invention to a paper envelope F1 (called rectangular No. 3 or rectangular No. 4). This envelope F1 is formed on one side (the right side in the figures) with an opening-side flap 15 that covers an opening 8 into which contents S are inserted, and on the opposite side (the left side in the figures) with a seal-side flap 16. Both the opening-side flap 15 and the seal-side flap 16 are provided as folding back to the outer periphery of the envelope F1 and adhered to the envelope by means of an adhesive or other such means. The opening 8 of the envelope F1 is disposed on the side of the opening-side flap 15. It is noted that FIG. 1 and FIG. 2 show the back wall 1*b* of the envelope F1 and that the position at which the envelope is to be opened is given an arrow mark for easy reference.

The envelope F1 is formed with an array of perforations M1 for opening the envelope along the opening 8. The array of perforations M1 for opening the envelope helps the opening-side flap 15 to open the envelope and is formed on the outer surface of the envelope F1 but is concealed by the opening-side flap 15 when it is folded back. The array of perforations M1 in this embodiment is substantially linear one, with the opposite end perforations M1*a* and M1*b* extending to the peripheral side fold lines of the envelope F1. However, this is by no means limitative. It will suffice if the opposite end perforations extend to the neighborhood of the peripheral side parts. Otherwise, the array of perforations may be formed substantially in the shape of the letter "U" so that the opposite end perforations reach the opening 8 (refer to FIGS. 2, 4 and 5). The array of perforations M1 including the opposite end perforations M1*a* and M1*b* is substantially a linear one and has parts that are not concealed by the opening-side flap 15, because the opening-side flap 15 assumes a substantially trapezoidal shape. If the opening-side flap 15 is rectangular with its opposite sides coincident with the opposite sides of the envelope F2, the opposite end perforations M1*a* and M1*b* of the array of perforations M1 will be completely concealed. Thus, envelopes with part of the array of perforations not concealed by the opening-side flap 15 are included in the present invention.

Figure 12:
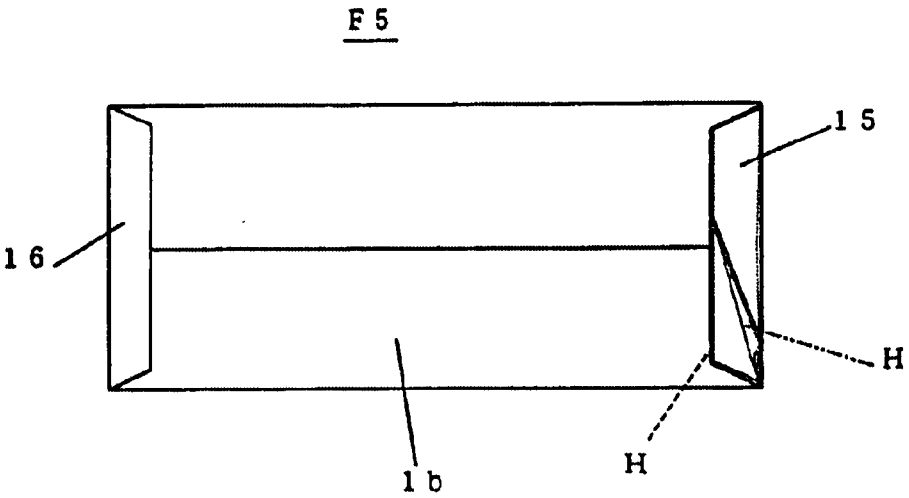
FIG. 12 is a rear view showing still another modification of the envelope of the first embodiment according to the present invention.
Figure 13:
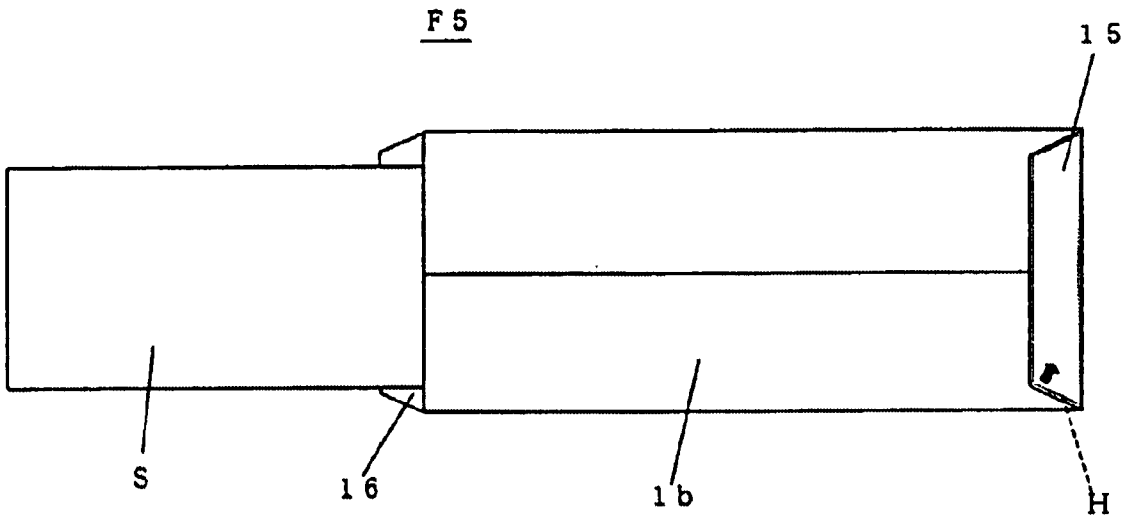
FIG. 13 is a rear view showing the modification of the envelope of the first embodiment according to the present invention, with the contents being inserted.

At the positions in the vicinity of the array of perforations M1 for opening the envelope, there are provided at predetermined intervals adhesive spots 10A for sealing that allow the opening-side flap 15 to adhere to the outer surface of the envelope F1. Though the adhesive spots 10A are usually for allowing the opening-side flap 15 to adhere to the outer surface of the envelope F1, these also serve as means for attaining easy and clear-cut opening of the envelope. To be specific, when the envelope is to be opened with the fingers pinching an outer peripheral end 15*a* of the opening-side flap 15, the adhesive spots 10A for sealing that are disposed at predetermined intervals cause the opening-side envelope 15 to pull the array of perforations M1 upward. For this reason, the envelope can be opened more easily than in the case of an adhesive applied to the entire surface. The adhesive spots 10A are formed inside of the array of perforations M1 for opening (at the upper side in the figures). However, this is by no means limitative. It will suffice if the adhesive spots are disposed in the vicinity of the array of perforations M1 for sealing. These may also be disposed so as to straddle the array of perforations M1 for sealing. The adhesive spots 10A may consist of adhesives or double-bonded adhesive tapes. Otherwise, these may be those subjected to seal processing so that splitting-off is easy to conduct. In recent years, post cards subjected to the seal processing can be found. A heat seal layer H is formed on one surface of a post card, and a facing surface is brought into pressure contact with the one surface. The facing surface is easy to open and looks like a cellophane paper surface (refer to FIG. 12). In this embodiment, as shown in FIG. 12, the opening-side flap 15 and a part of the outer surface of an envelope F5 to which the flap is attached are subjected to seal processing and brought into pressure contact with each other, thereby constituting the envelope F5. In the case of the pressure contact by seal processing, a way to insert contents as shown in FIG. 13 and described later will be advantageous. In each of the embodiments, the position of the adhesive spots 10A for sealing is on the side of opening-side flap 15. However, the position may be a corresponding position on the back wall (the outer surface on the side of the opening) 1*b* of the envelope F1.

When using the envelope F1 of this embodiment shown in FIG. 1, contents S are inserted into the envelope F1 from its opening 8 and the envelope is closed utilizing the adhesive spots 10A to which adhesives or double-bonded adhesive tapes are applied. How to insert the contents is the same as in the case of a conventional ordinary envelope. A receiver who receives the envelope (sealed document) F1 opens the same by pinching the outer peripheral end 15*a* of the opening-side flap 15 with his/her fingers. How to open the envelope is the same as in the case of a conventional ordinary envelope. When the opening-side flap 15 folded back is intended to develop, the adhesive spots 10A for sealing in the vicinity of the array of perforations M1 for opening to which adhesives or double-bonded adhesive tapes are applied pull the portion of the array upward. As a result, the envelope is infallibly opened along the array of perforations M1 for opening in a clear-cut manner. That is to say, the flap is intended to split off from the arrow mark in FIG. 1, a force of splitting the flap off along the array of perforations M1 for opening is exerted on the portion of the array. For this reason, the envelope can be opened smoothly and rhythmically along the array of perforations M1 in a clear-cut manner. Upon splitting-of reaching the opposite end perforation M1*a* or M1*b*, the envelope F1 is opened along its outer peripheral fold line. In this case, the clear-cut opening can be established even if splitting-off commences from at any point of the outer peripheral end 15*a* of the opening-side flap 15 not provided with adhesives etc. This means that the initial splitting-off part is not always the part to which the arrow mark is given in FIG. 1. Where adhesives etc. are applied to the inside only of the array of perforations M1 for opening, the one side is pulled. This ensures more clear-cut and infallible opening along the array of perforations M1. The opening-side flap 15 after opening the envelope along the array of perforations M1 has traces of perforations as shown in FIG. 2.

In this embodiment, since the array of perforations M1 of the envelope F1 is covered with the adhered opening-side flap, it is not discernible from the outside. This envelope looks like the one formed with no perforation and has no possibility of water, such as rainwater, entering it. Therefore, it is unnecessary for the portion provided with the array of perforations M1 to be waterproofed for the purpose of preventing rainwater etc. from entering the envelope. Since the difference between an ordinary envelope and the envelope of this embodiment excluding the range of the adhesive spots 10A is the absence or presence of the array of perforations M1, the envelope of this embodiment can be manufactured with extreme ease. Therefore, the present invention is applicable to a blank folded back to form a conventional ordinary envelope. How to open the envelope F1 of this embodiment is the same as the way to open an envelope formed with no perforation, and the envelope F1 is not fragile in spite of the presence of the array of perforations M1 because the array is closed with the opening-side flap 15. For this reason, there is no possibility of the envelope being cut out from the array of perforations M1 for opening even when being extremely bent during mailing.

The side of the seal-side flap 16 may optionally be formed with an additional array of perforations M1 for opening so that the array is covered with the seal-side flap 16, in the same manner as on the side of the opening-side flap 15. When a receiver who receives this envelope (sealed document) intends to erroneously open the envelope from the side of the seal-side flap 16, the envelope can be opened along the additional array of perforations M1 in the same manner as from the side of the opening-side flap 15. In this case, the seal-side flap 16 serves as the opening-side flap 15. This case in which the envelope opening position is on the side of the seal-side flap 16 is included in the present invention.

Figure 3:
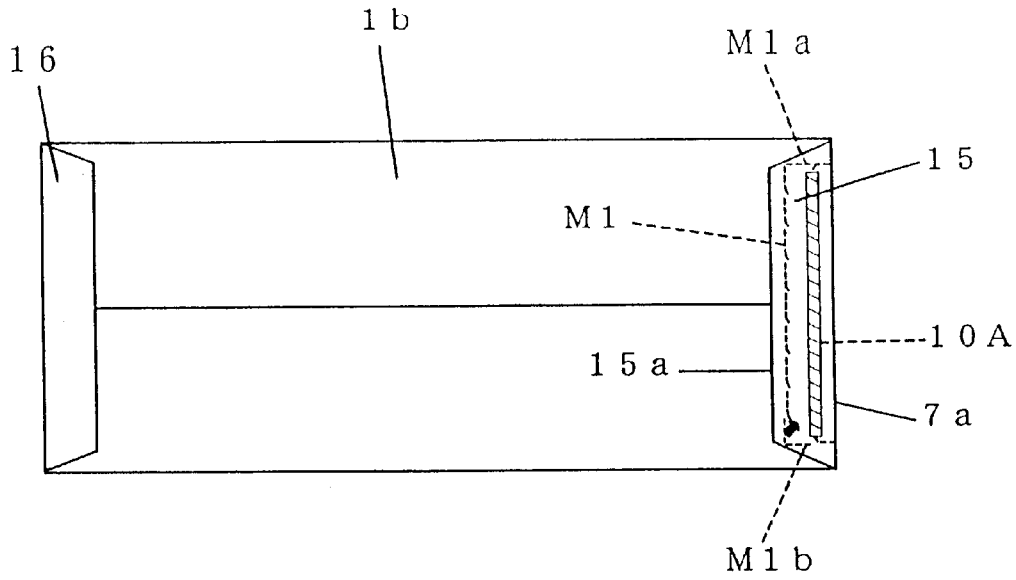
FIG. 3 is a rear view showing a modification of the first embodiment.

A modification of the first embodiment will be described. The array of perforations M1 of an envelope F1*a* is formed substantially in the shape of the letter "U" as shown in FIG. 3 so that the opposite end perforations reach the opening 8. To be specific, the opposite end perforations M1*a* and M1*b* are at right angles relative to those of the first embodiment and extend to the opening 8. In this case, the perforations of the perforation array M1 at the right-angle portions preferably have a large size. This is because the envelope can be opened smoothly along the perforations M1, M1*a* and M1*b* at the right-angle portions without need of an excessively forcible force. Since the array of perforations including the perpendicular opposite-end perforations is formed substantially in the shape of the letter "U", it can be covered with the substantially trapezoidal opening-side flap 15.

(Second Embodiment)

Figure 4:
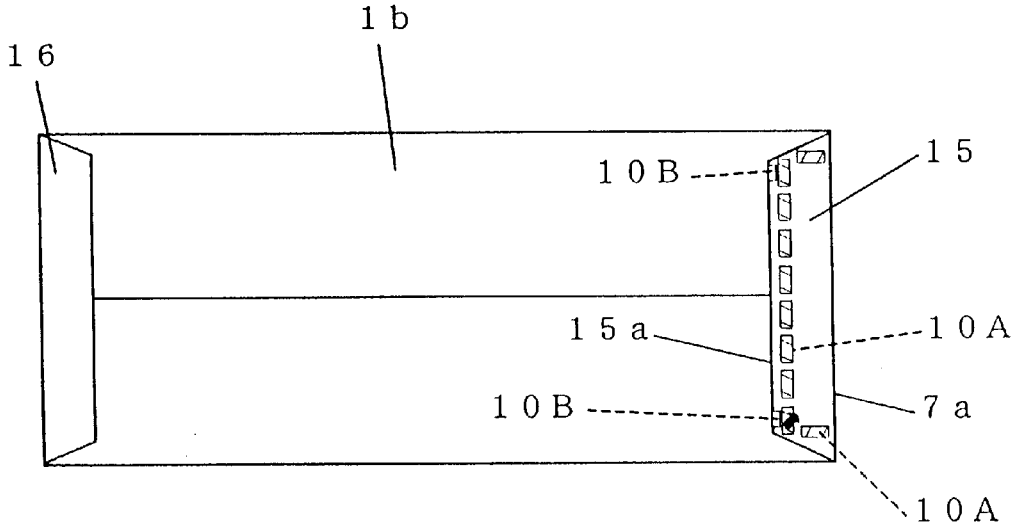
FIG. 4 is a rear view showing an envelope according to the second embodiment of the present invention.

This embodiment applies the present invention to a paper envelope F2 (called rectangular No. 3 or rectangular No. 4) as shown in FIG. 4. This envelope F2 is formed on one side (the right side in the figures) with an opening-side flap 15 that covers an opening 8 into which contents S are inserted, and on the opposite side (the left side in the figure) with a seal-side flap 16. The opening of this envelope F2 is disposed on the side of the opening-side flap 15 and provided with no perforation M1 but adhesive spots 10A disposed at predetermined intervals for sealing the proximal end of the opening-side flap 15 when folded back. To be specific, an adhesive such as paste is applied in the lengthwise direction to the proximal end of the opening-side flap 15, and the proximal end is attached at predetermined intervals to the outer surface of the envelope. Various patterns of the adhesive such as paste are conceivable, including scattering application, local application and application at variable intervals.

The outer peripheral end 15*a* of the opening-side flap 15 is provided locally with adhesive spots 10B for preventing outward spread of the opening-side flap 15. There are some portions of the outer peripheral end provided with the spread-preventing adhesive spots 10B (at predetermined intervals) so that the opening-side flap 15 is not split off during mailing. There provide plural portions of the outer peripheral end 15*a* without the spread-preventing adhesive spots 10B for easily pinching between the fingers and promoting opening of the envelope from any one of the portions. Though it is not shown, scattering application of an adhesive to the spread-preventing adhesive spots 10B is advantageous. Scattering application of an adhesive to both the sealing adhesive spots 10A and the spread-preventing adhesive spots 10B is also advantageous. This is because the tensile strength in opening the envelope can be spread, thereby enabling smooth, rhythmical, clear-cut opening of the envelope. The envelope with these advantages is suitable for encasing a card for invitation to a wedding party that is to be held beautiful.

Therefore, since this embodiment is provided without the array of perforations M1 as is adopted in the first embodiment, but with the adhesive spots 10B at predetermined intervals for sealing the proximal end of the opening-side flap 15, the adhesive spots function like the array of perforations M1. When a receiver who receives the envelope F2 opens the same, pinching a portion of the outer peripheral end 15*a* of the opening-side flap 15, the envelope is cut out (split off) from the adhesive spots adhered at predetermined intervals. Thus, the envelope can be easily and infallibly opened in the same manner as the envelope provided with the array of perforations M1.

(Third Embodiment)

Figure 5:
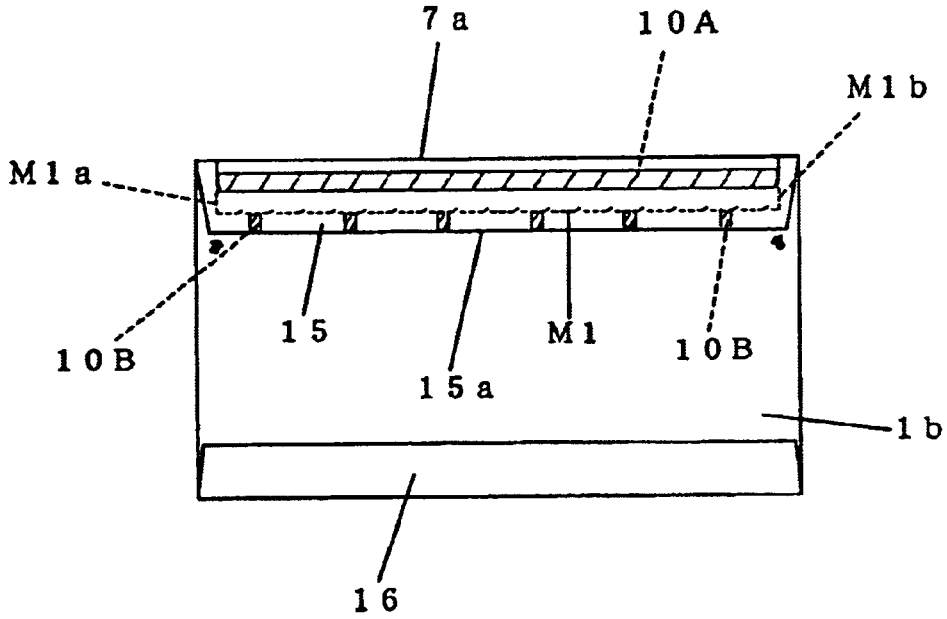
FIG. 5 is a rear view showing an envelope according to the third embodiment of the present invention.
Figure 6:
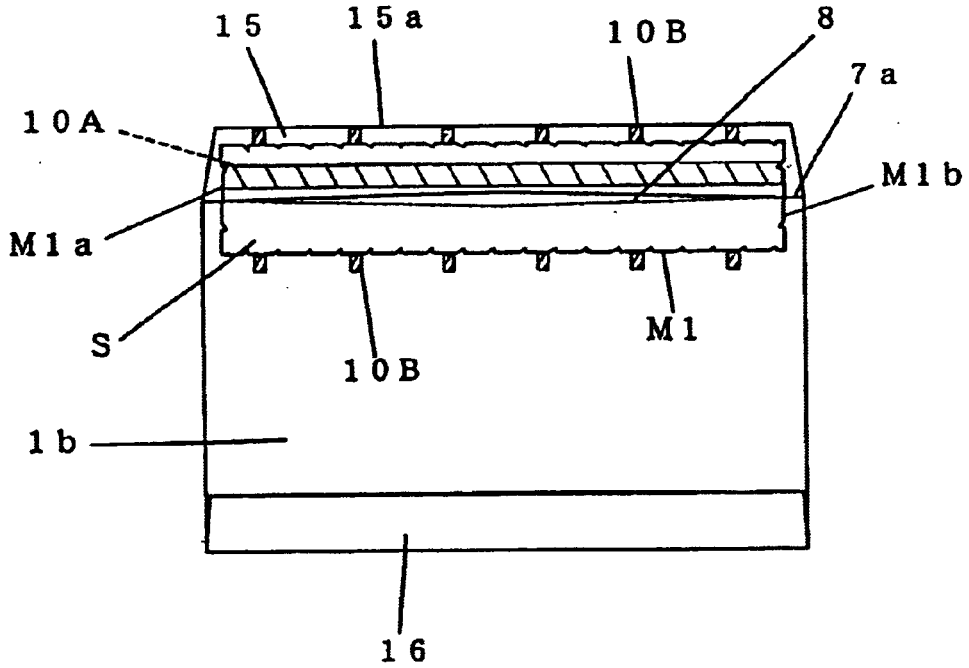
FIG. 6 is a rear view showing an envelope according to the third embodiment, with an opening-side flap developed.

This embodiment applies the present invention to a paper envelope F3 as shown in FIG. 5 and FIG. 6. This envelope F3 is formed on one side (the top side in the figures) with an opening-side flap 15 that covers an opening 8 into which contents S are inserted, and on the opposite side (the bottom side in the figure) with a seal-side flap 16. The opening 8 of this envelope F3 is disposed on the side of the opening-side flap 15. An array of perforations M1 for opening in the present embodiment extends linearly along the opening 8 and assumes a U-shape, with the opposite end perforations M1*a* and M1*b* not reaching the peripheral fold lines of the envelope F3.

The outer peripheral end 15*a* of the opening-side flap 15 is provided locally with adhesive spots 10B for preventing outward spread of the opening-side flap 15. There are some portions of the outer peripheral end provided with the spread-preventing adhesive spots 10B (at predetermined intervals) so that the opening-side flap 15 is not split off during mailing. There provide plural portions of the outer peripheral end 15*a* without the spread-preventing adhesive spots 10B for easy pinching between the fingers and promoting opening of the envelope from any one of the portions. Though it is not shown specifically, scattering application of an adhesive to the spread-preventing adhesive spots 10B is advantageous. Scattering application of an adhesive to both the sealing adhesive spots 10A and the spread-preventing adhesive spots 10B is also advantageous. This is because the tensile strength in opening the envelope can be spread, thereby enabling smooth, rhythmical, clear-cut opening of the envelope. The envelope with these advantages is suitable for encasing a card for invitation to a wedding party that is to be held beautiful.

According to this embodiment, therefore, when the envelope is intended to be opened, pinching a portion of the outer peripheral end 15*a* of the opening-side flap 15 provided without the spread-preventing adhesive spots 10B, the portion of the perforation array M1 is pulled up due to the presence of adhesives or double-bonded adhesive tapes applied to the positions of sealing adhesive spots 10A in the vicinity of the perforation array M1. As a result, the envelope can be infallibly opened along the perforation array M1 in a clear-cut fashion. Due to the presence of the opposite end perforations M1*a* and M1*b* of the perforation array M1, the open part of the opened envelope assumes a U-shape. In this embodiment, the envelope is infallibly opened in a clear-cut fashion from either of the position indicated by the arrow marks in FIG. 5. It is noted that the spread-preventing adhesive spots 10B and the adhesive scattering application can be used in the first embodiment and third and forth embodiments that will be described layer.

(Fourth Embodiment)

Figure 7:
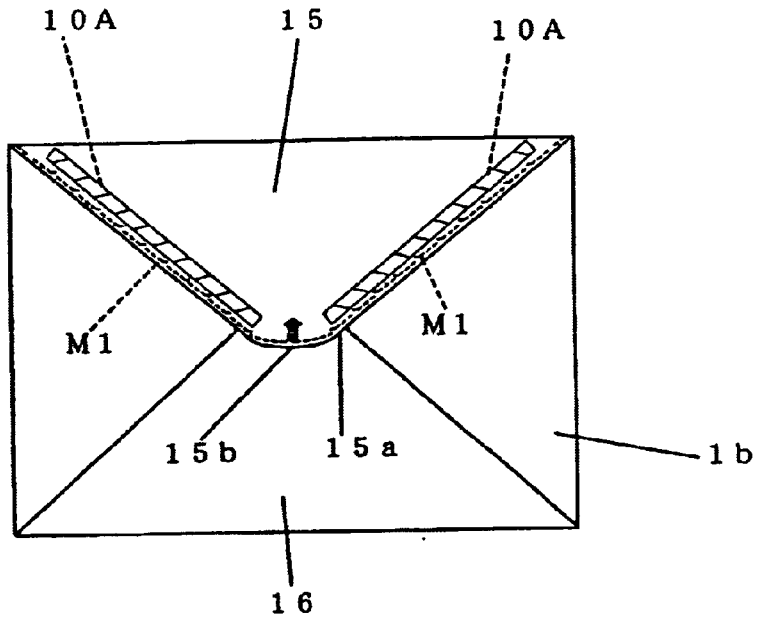
FIG. 7 is a rear view showing an envelope according to the fourth embodiment.
Figure 8:
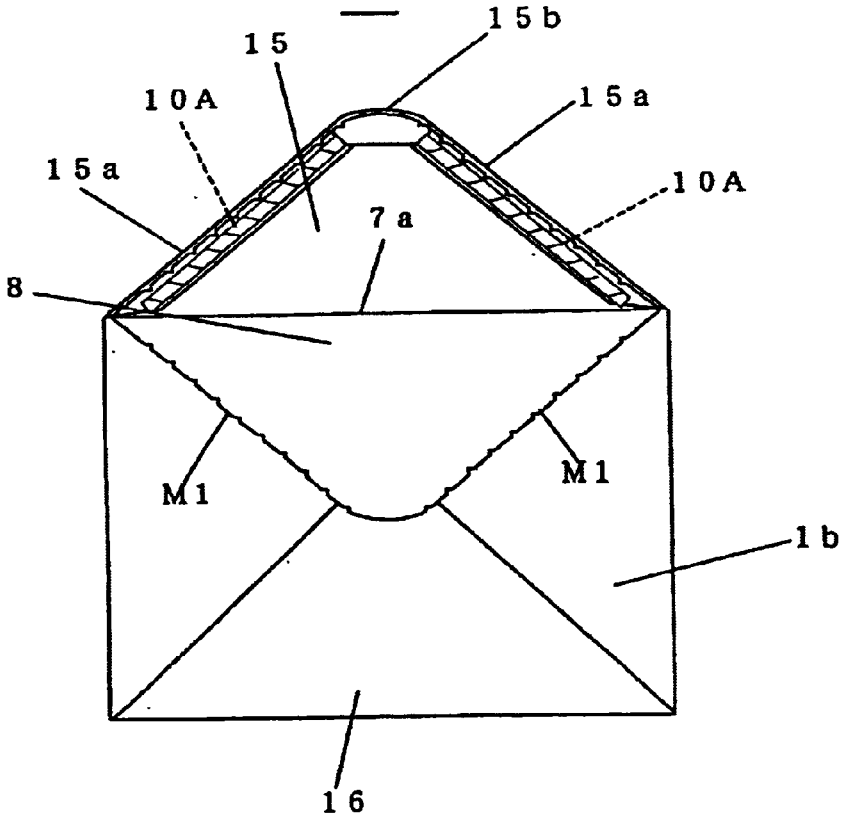
FIG. 8 is a rear view showing the envelope according to the fourth embodiment, with an opening-side flap developed.

This embodiment applies the present invention to a so-called overseas envelope F4 as shown in FIG. 7 and FIG. 8. This envelope F4 is formed on one side (the top side in the figures) with a substantially triangular-shaped opening-side flap 15 that covers an opening 8 into which contents S are inserted, and on the opposite side (the bottom side in the figures) with a substantially triangular-shaped seal-side flap 16. The opening 8 assumes a substantially triangular shape.

At the opening 8 of this envelope F4, an array of perforations M1 for opening is formed along the opening 8. To be specific, a single array of perforations M1 in a substantially triangular shaped is formed on the back wall 1*b* of the envelope F4 along the opening 8. Adhesive spots 10A for sealing in this embodiment may be ones straddling, or ones disposed inside of the single array of perforations M1 insofar as it is disposed in the vicinity of the single array of perforations M1. It is noted that an adhesive spot 10A is not provided on an apex part 15*b* at the center of the opening-side flap 15.

When a receiver who receives the envelope F4 of this embodiment intends to open the same, pinching the apex part 15*b* (refer to the arrow mark) of the substantially rectangular opening-side flap 15 with his/her fingers, the opening-side flap 15 pulls the portion of the perforation array M1 upward via the adhesive spots 10A. As a result, the envelope can be opened smoothly along the perforation array M1 in a clear-cut manner without part of the opening-side flap being left remaining, as is done in a conventional envelope. The envelope F4 of this embodiment is made of paper as well as the envelope F1 of the first embodiment. However, this is by no means limitative. It may be made of a plastic film. In addition, this embodiment is applicable to a window envelope, in which a transparent plastic film is attached to a portion thereof where the address including the name or appellation is shown.

In the meantime, there is a case where anyone requests an agency (including an agent) to prepare sealed documents in order for a great number of sealed documents to be mailed. In this case, the agency etc. will usually purchase exclusive envelopes or use available envelopes. It will be advantageous for the agency etc. to insert contents S into the envelopes and for a receiver to open an envelope if the envelopes F1, F2 and F3 of the aforementioned embodiments are used in the following manner.

Figure 9:
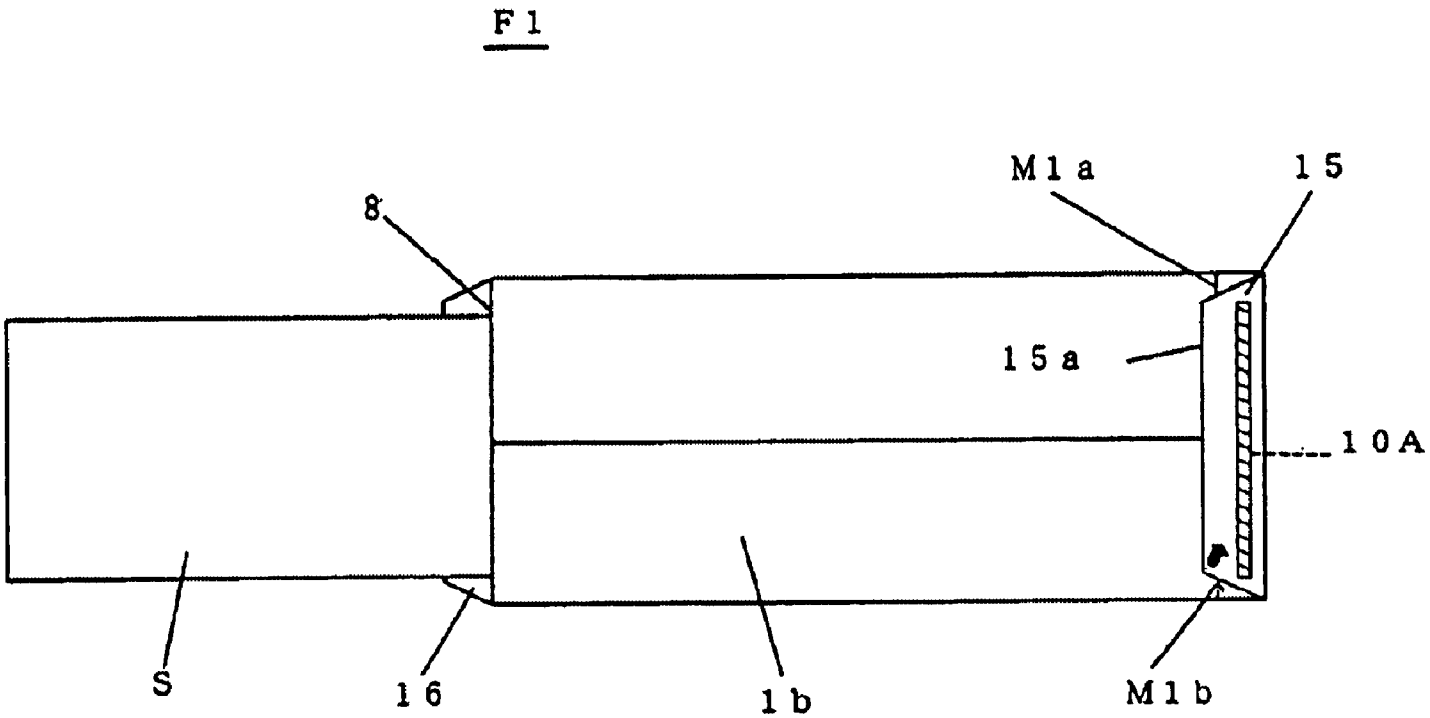
FIG. 9 is a rear view showing another modification of the envelope of the first embodiment.
Figure 10:
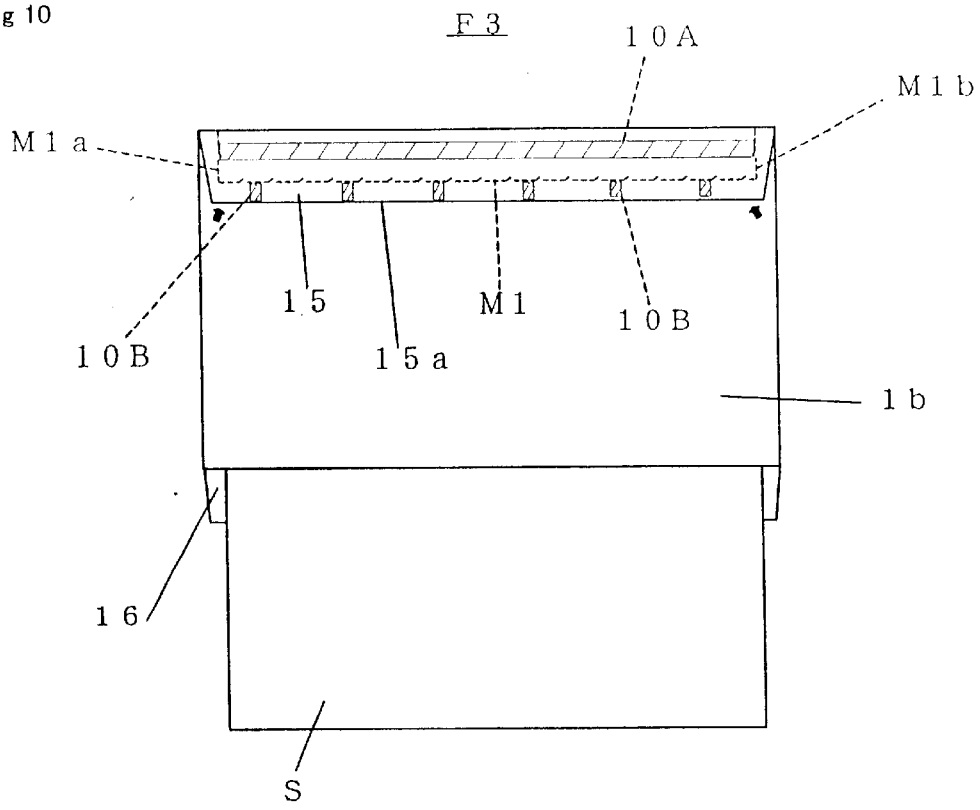
FIG. 10 is a rear view showing a modification of the envelope of the third embodiment.
Figure 11:
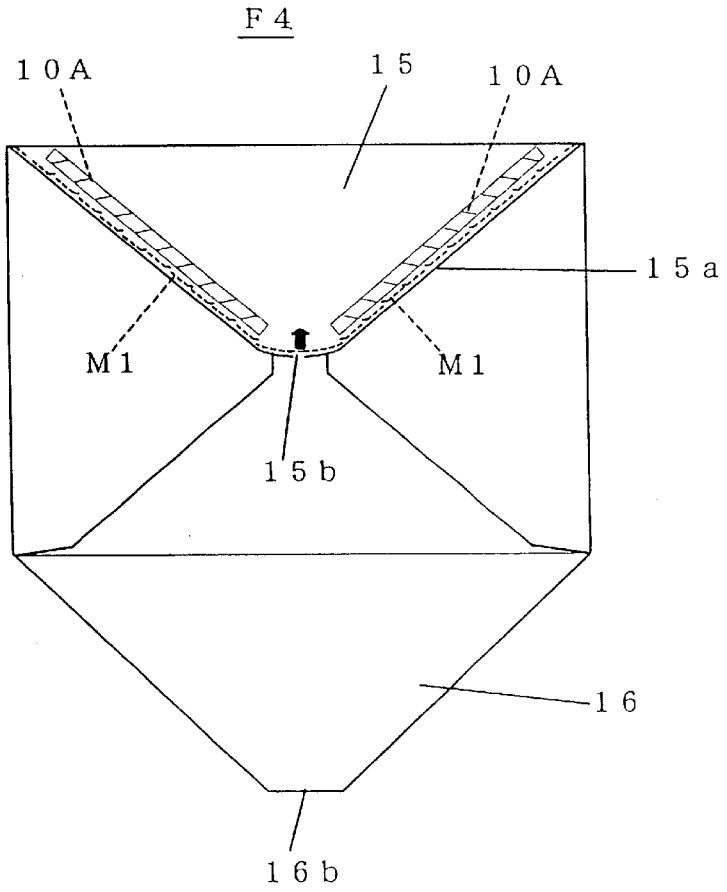
FIG. 11 is a rear view showing a modification of the envelope of the fourth embodiment.

As shown in FIG. 9, in the case of the first embodiment, while the opening-side flap 15 is sealed via the adhesives etc., contents S are inserted into the envelope from the seal-side flap 16 on the opposite side (lower side in FIG. 9) before the seal-side flap is pasted. After insertion of the contents S, the seal-side flap 16 is completely pasted up on the back wall of the envelope. As shown in FIG. 10, in the case of the third embodiment, while the opening-side flap 15 is sealed via the adhesives etc., contents S are inserted into the envelope from the seal-side flap 16 on the opposite side (lower side in FIG. 10) before the seal-side flap is pasted. After insertion of the contents S, the seal-side flap 16 is completely pasted up on the back wall of the envelope. As shown in FIG. 11, in the case of the fourth embodiment, while the opening-side flap 15 is sealed via the adhesives etc., contents S are inserted into the envelope from the seal-side flap 16 on the opposite side (lower side in FIG. 11) before the seal-side flap is pasted. In this case, the portions of the substantially rectangular seal-side envelope excluding its apex part 16*b* are pasted, and the apex part 16*b* is inserted into the corresponding apex part 15*b* of the opening-side flap 15 after insertion of the contents S. By inserting the contents S into the envelope from the opposite side (lower side in FIG. 11) as described above, damage of the perforation array M1, failure to infallible attachment of the opening-side flap 15 and other such inconvenience can be eliminated even when an agency etc. performs insertion work for a great number of sealed documents to be mailed. Thus, the insertion work is easy and infallible to perform, and is more convenient. The envelopes (or sealed documents) with contents S sealed therein completely can be mailed.

As regards the envelope F5 having the flap subjected to seal processing and attached under pressure, as shown in FIG. 12, contents are inserted in the same manner as described above. That is to say, a receiver who receives this envelope can open the same with ease form the opening 8. This is because most flaps subjected to seal processing do not resume their original state. In view of this, the envelope F5 is used, as shown in FIG. 13, by inserting contents S into the envelope from an opening of the seal-side flap 16 and sealing the seal-side flap. This eliminates damage of the perforation array M1, failure to infallible attachment of the opening-side flap 15 and other such inconvenience when inserting the contents. Thus, the envelopes (or sealed documents) F5 with contents S sealed therein completely can be mailed.

(Fifth Embodiment)

Figure 14:
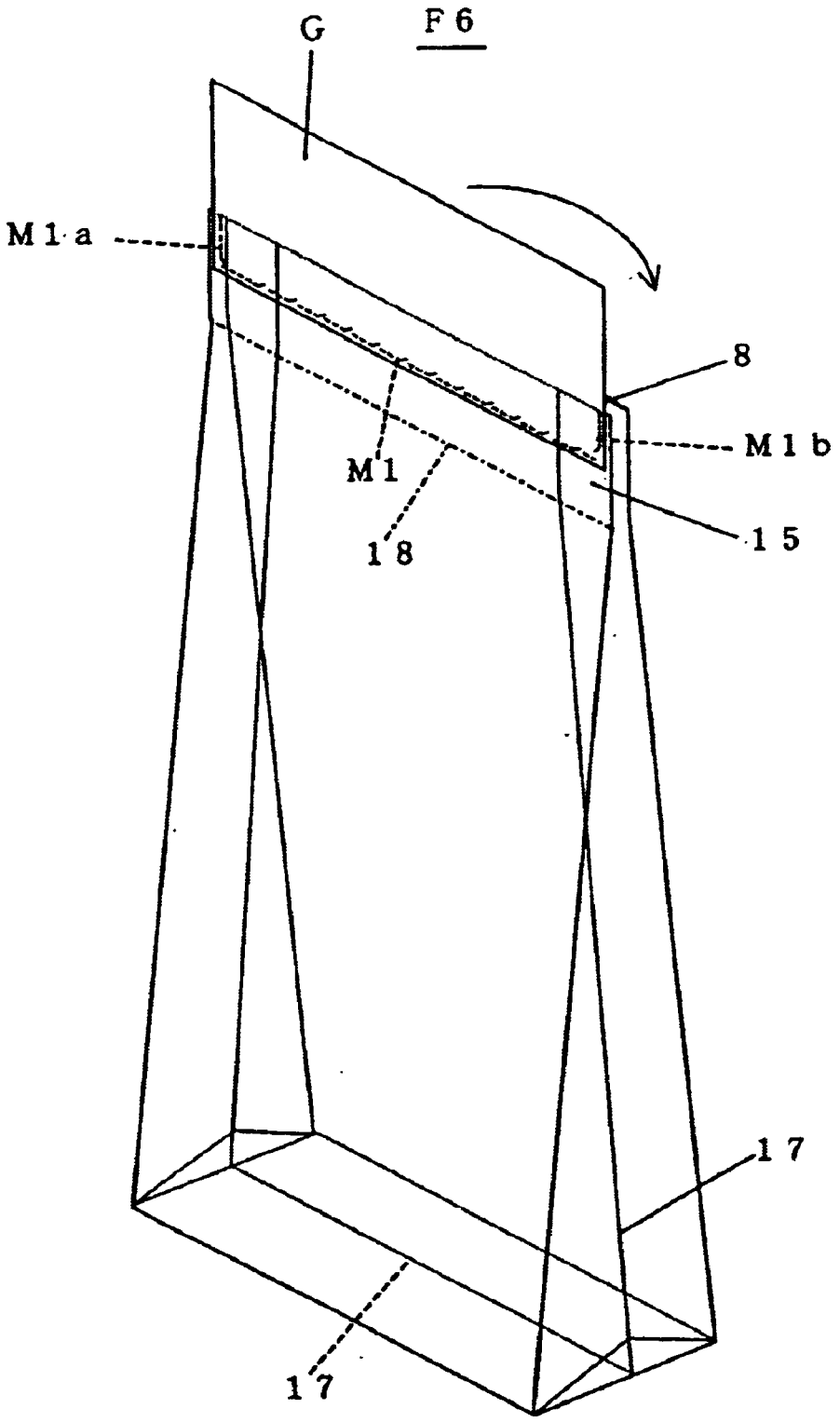
FIG. 14 is a rear view showing an envelope of the fifth embodiment according to the present invention.

This embodiment applies the present invention to a large-sized envelope F6 as shown in FIG. 14. This envelope is formed on one side (the top side in the figure) with an opening-side flap 15 that covers an opening into which contents S are inserted and on the opposite side (the bottom side in the figure) with a fold-up portion 17 that is expanded in accordance with the amount of the contents. This large-sized envelope F6 can be called an "envelope-shaped container" that is a more suitable expression, and has a predetermined thickness so that a great number of documents can be inserted therein, with the width adjustable by the fold-up amount of the fold-up portion 17. The open-side flap 15 to which a gummed tape G or double-bonded adhesive tape is attached is bent at a fold-back line 18 (in the direction indicated by the arrow mark in the figure). If the contents S are stored in the bottom of the envelope, the fold-back is conducted plural times and the interface between last fold-back portion and the surface of the envelope is staggered by the gummed tape G (or double-bonded adhesive tape) for attaching the two.

This type of container F6 is one of envelopes used as a postal parcel, a container for home delivery, etc. This envelope F6 is formed with an array of perforations M1 for opening along the opening 8 thereof. Other constitution is similar to those of the first to fourth embodiments. Also in this embodiment, therefore, when a receiver who receives the envelope F6 intends to open the envelope, with his/her fingers pinching the end of the gummed tape G, the opening-side flap 15 pulls the portion of the perforation array M1 upward via the adhesive spots 10A for sealing. As a result, the envelope can be opened in a clear-cut fashion. As is clear from this embodiment, the present invention can be applied widely to containers having an opening-side flap 15 folded back to close the opening 8.

(Sixth Embodiment)

Figure 15:
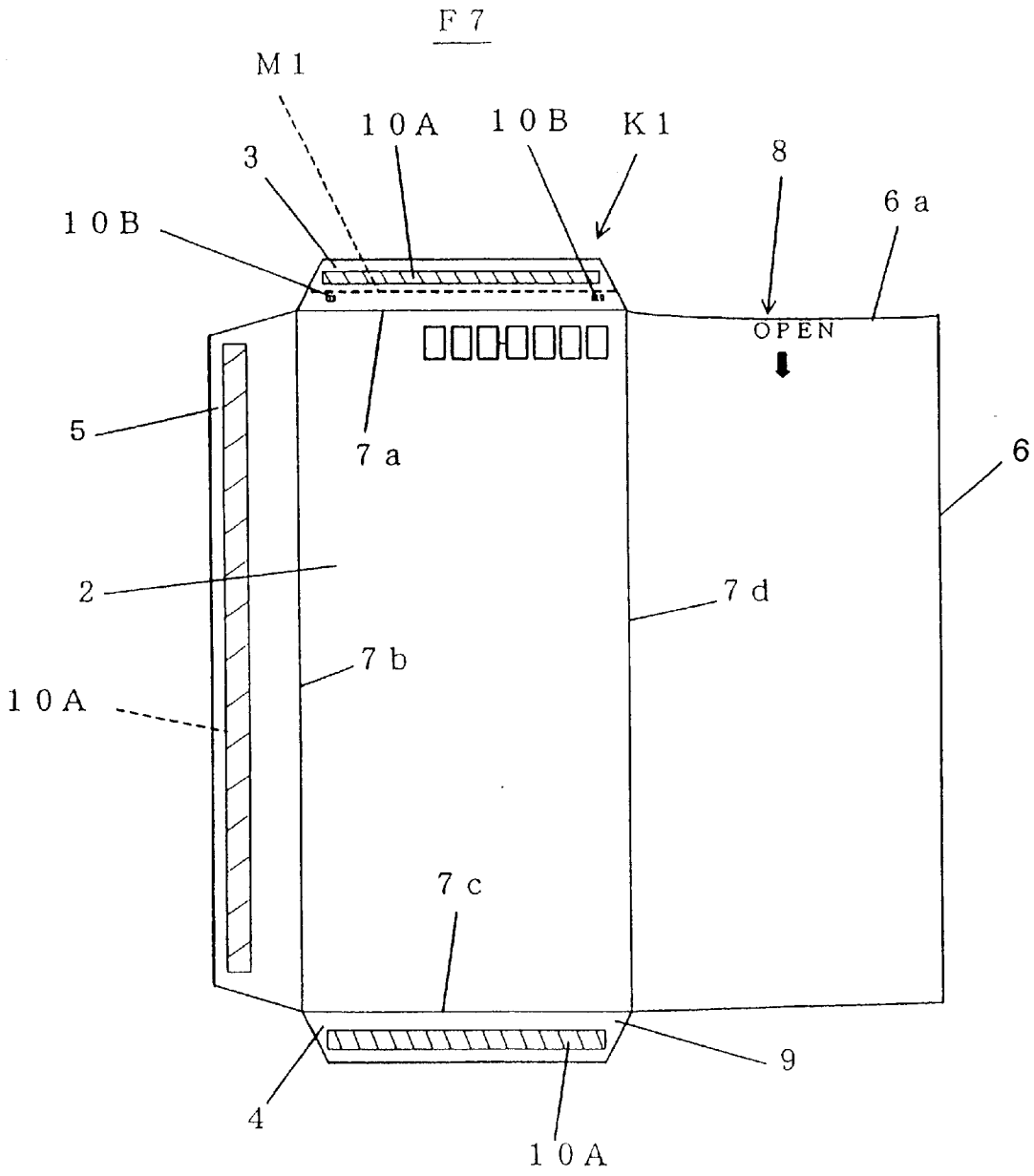
FIG. 15 is a front view showing, in a developed state, a blank to be folded to form an envelope of the sixth embodiment according to the present invention.
Figure 16:
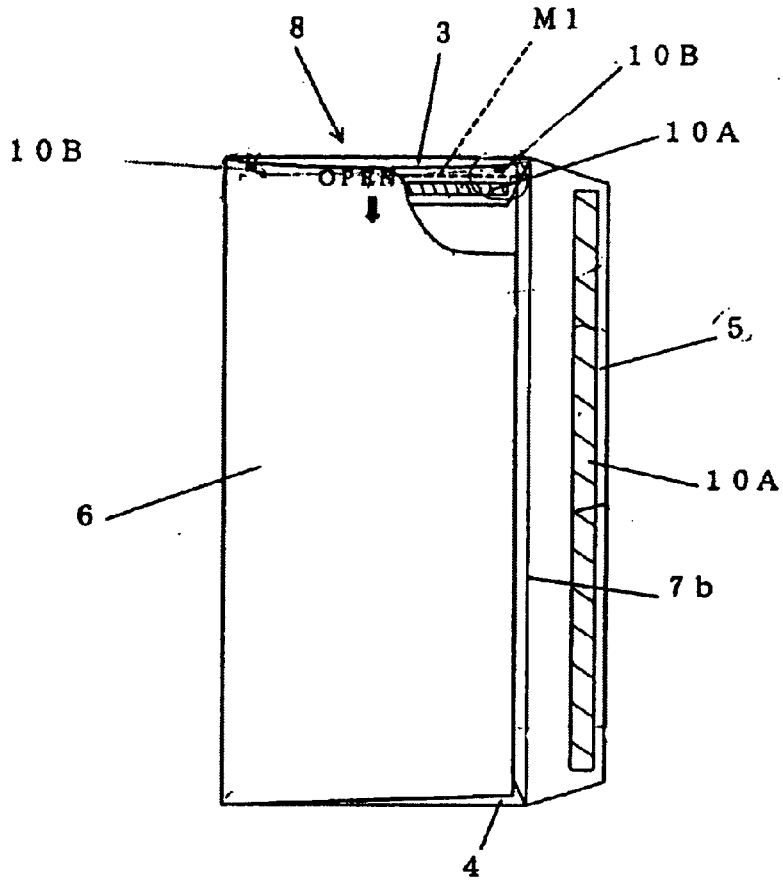
FIG. 16 a rear view explaining the order of folding the blank into the envelope of the sixth embodiment.

This embodiment refers to a paper envelope F7 (called rectangular No. 3 or rectangular No. 4) as shown in FIG. 15 and FIG. 16. A blank K1 to be folded to form the envelope comprises, in a developed state, a center sheet 2, outer peripheral flaps 3, 4 and 5 folded back on the periphery of the center sheet 2, and an overlapping sheet 6 overlaid on the outer peripheral flaps 3 and 4.

The center sheet 2 has a rectangular shape on which a postal code number column is printed and an address is shown. It is formed on the four peripheral sides with the outer peripheral flaps 3, 4 and 5 and the overlapping sheet 6 via fold lines 7*a*, 7*c*, 7*b* and 7*d*, respectively. The flaps are easy to fold back, with the fold lines 7*a*, 7*b*, 7*c* and 7*d* as the boundaries. The outer peripheral flaps 3, 4 and 5 in this embodiment are formed in their respective lengthwise directions with margins 9 to paste up, which margins are being pasted. On the other hand, the overlapping sheet 6 is not formed with an adhesive spot 10A for sealing. The margins 9 to paste up may be ones to which a double-bonded tape is attached or an adhesive is applied over their entire surfaces.

The outer peripheral flap 3 on the upper side of the center sheet 2 is formed with an array of perforations M1 for opening, extending in the lengthwise direction. The upper side of the perforation array is formed with a margin 9 to paste up, which margin extends in the lengthwise direction and is being pasted, and the lower side of the perforation array is formed with spread-preventing adhesive spots 10B disposed at predetermined intervals. Since the perforation array M1 for opening extends over the entire area of the outer peripheral flap 3 in the lengthwise direction, it makes envelope opening easy. However, it may be formed at a part of the outer peripheral flap 3 at the center position of the length of the flap, thereby making it possible to open the envelope at the initial stage. In this case, the initial-stage opening force action can open the envelope up to its opposite ends. The outer peripheral flaps 4 and 5 on the bottom and left sides of the center sheet 2 are identical with those of an ordinary envelope. The interval of the spread-preventing adhesive spots 10B is optionally set.

The overlapping sheet 6 is a back sheet folded back to the back side of the center sheet 2 and assumes a substantially rectangular shape having substantially the same size as the center sheet 2. One of the outer peripheral ends of the overlapping sheet 6 (the upper side 6*a* in FIG. 15) is the portion serving as the opening 8 for opening the envelope. The outer peripheral end 6*a* (on the upper side) describes a gentle arc so that it is positioned inside a fold line 7*a* of the outer peripheral flap 3. It is noted that the outer peripheral end 6*a* may be formed with a corrugated portion of a size as large as the thumb so that the finger is easy to engage with. In this embodiment, an arrow mark for indicating the center position and the word "open" are printed on the overlapping sheet 6 at the outer peripheral end. Thus, a step is formed between the overlapping sheet 6 and the outer peripheral flap 3 so that it can be pinched with the fingers. Here, it can be said that the overlapping sheet 6 is one of the outer peripheral flaps 3, 4 and 5 and that each of the outer peripheral flaps 3, 4 and 5 is one of the overlapping sheet 6. The envelope F7 in this embodiment is identical with an ordinary envelope except for the perforation array M1 for opening and the spread-preventing adhesive spots 10B. Therefore, it can be produced with ease using an ordinary envelope.

Perforation arrays M1, M2 and M3 used in the description are widely known arrays of minute perforations that are formed in an admission card or other such ticket for dividing it into two halves. However, it may be an array of largely cut scores or perforations easy to cut off (called "zipper-type perforations" and also called "bellows-type perforations"). Even with the minute perforations, a cut-off portion will not come out of the array of perforations. It is noted that the perforation array used herein includes widely known arrays of perforations, such as a series of continuous cutouts, in addition to the aforementioned perforation arrays. Furthermore, it includes the case where pasted portions are disposed at predetermined intervals, as described in the fourth embodiment that will be touched upon later. That is to say, in this embodiment, if the outer peripheral flap 5 and the overlapping sheet 6 are adhered at predetermined intervals with paste, cutout portions at predetermined intervals can be obtained. Therefore, this case is also included in this embodiment. The perforation array M1 is for opening the envelope and may comprise two or more arrays of perforations as occasion demands in practice.

Figure 17:
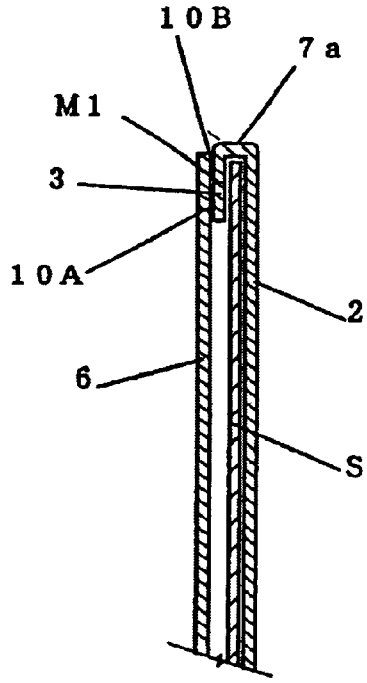
FIG. 17 is a cross-sectional view showing an open side of the envelope of the sixth embodiment.

When a developed blank K1 is to be folded to form an envelope F7, therefore, the outer peripheral flaps 3 and 4 are first folded down to the backside of the center sheet along the fold lines 7*a* and 7*c*, respectively. The overlapping sheet 6 is then overlaid on and attached to the outer peripheral flaps. This formation order is shown from FIG. 15 to FIG. 16. In this way, the envelope F7 in this embodiment can be produced with ease. Since the arrow mark for opening is printed on the overlapping sheet 6, it can form a criterion of the folding order. According to the envelope F7 of this embodiment, the contents S can be inserted into the envelope to reach the end of the envelope, similarly in the case of conventional envelopes. That is to say, if the contents S extend over the four peripheral sides of the envelope F1 as shown in FIG. 17, the ends of the contents enter the underside of the outer peripheral flap 3 formed with the perforation array M1 for opening. Thus, the contents can be inserted to reach a position immediately before the opening 8. Therefore, if the contents have a large size like insurance certificates, contract-related documents, specifications, etc., these can be inserted into the envelope, similarly in the case of conventional envelopes.

Figure 18:
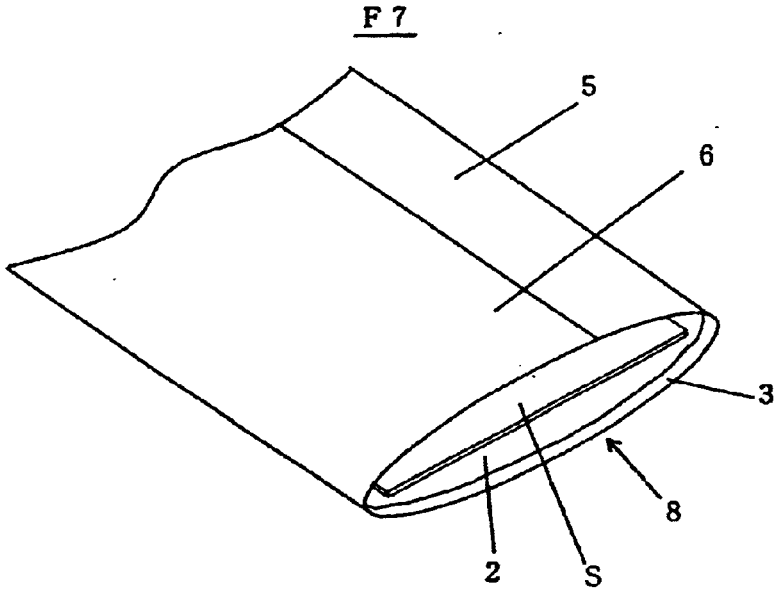
FIG. 18 is a perspective view showing the envelope of the sixth embodiment in an opened state.

In the envelope F7 of this embodiment having the aforementioned configuration, maintained in the state folded to form the envelope shown in FIG. 16, contents S are inserted and sealed. The outer peripheral flap 5 is then folded back and attached to the overlapping sheet 6 utilizing the margins 9 to paste up. If a receiver who receives the sealed document pinches the outer peripheral end 6*a* of the overlapping sheet 6, with the arrow mark printed thereon, using his/her fingers of one of the hands, also pinches the outer peripheral end of the outer peripheral flap 3 using his/her fingers of the other hand, and slightly pulls the pinched portions in the opposite directions, or otherwise, the receiver inserts a writing instrument, such as a ball-pointed pen, between the outer peripheral flap 3 and the overlapping sheet 6 and moves it, part of the envelope is cut off along the perforation array M1 in a clear-cut fashion to open the envelope F7 as shown in FIG. 18. While the receiver, when receiving the mailed envelope, does not recognize the presence of the perforation array M1 for opening from the outside, he/she can easily open the envelope in a clear-cut fashion with a small force using the arrow mark as a criteria, without use of a cutting tool such as scissors. After the envelope is opened, the portion of the perforation array M1 for opening is not discernible from the outside. Therefore, the (opened) envelope F7 is retained in a state of the cutout portion not discernible from the outside. When the part of the envelope has been cut out along the perforation array M1, the outer peripheral flap 3 is flexed inward as shown in FIG. 18. For this reason, the contents S are prevented from dropping out of the envelope. The envelope F7 of this embodiment can be used, similarly to a conventional envelope, for a sender (sending side).

According to this embodiment, the overlapping sheet 6 is overlaid on and attached to the outer peripheral flap 3 formed with the perforation array M1. For this reason, the presence of the perforation array M1 is not discernible from the outside. Therefore, there is no possibility of the envelope being readily opened during mailing and of the contents being wetted with rainwater that would otherwise enter the envelope. Furthermore, it is possible to avoid a hindrance to mechanical treatment at a post office (mailing office). This means that the "guideline relating to mechanically treatable mail (first-class and second-class mail)" can be satisfied. Moreover, the envelope of this embodiment can easily be produced by forming a conventional ordinary envelope blank with no perforation array, with an array of perforations and paying attention to the flap-folding order. It is noted that the envelope F7 of the present invention can easily be produced even from an envelope into which a conventional ordinary envelope blank is folded.

Figure 19:
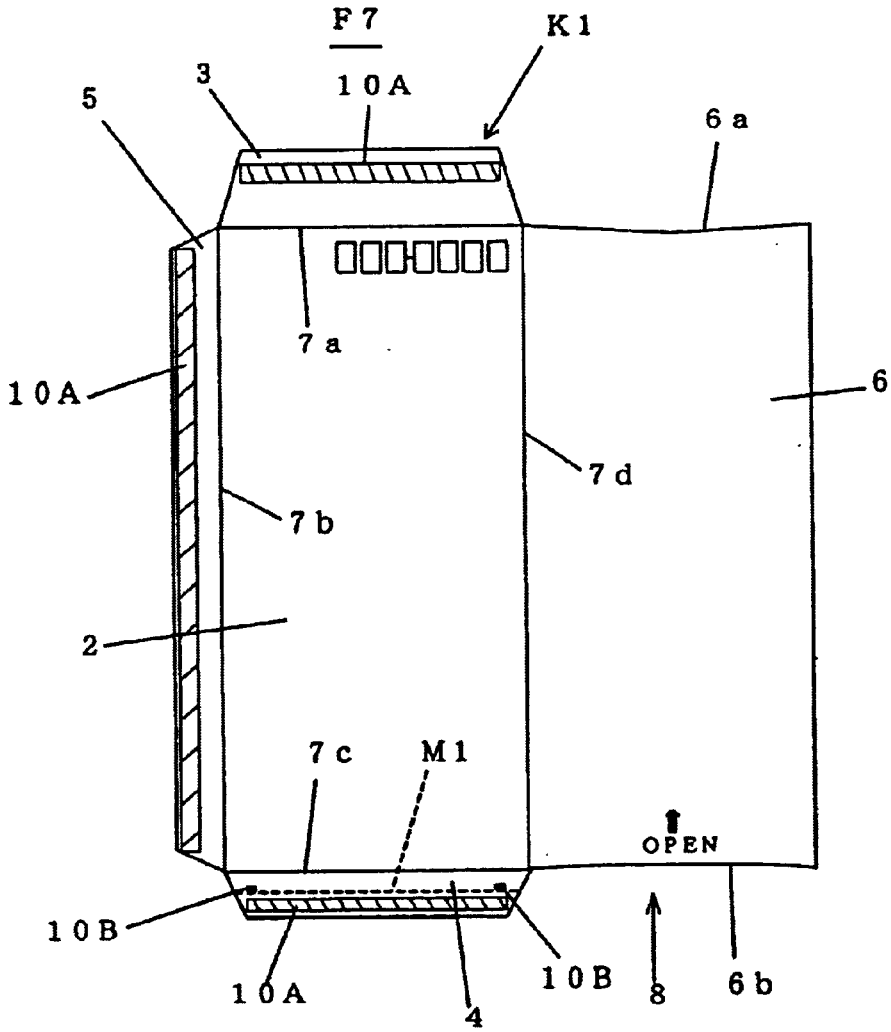
FIG. 19 is a front view showing a modification of the blank to be folded to form the envelope of the sixth embodiment according to the present invention.
Figure 20:
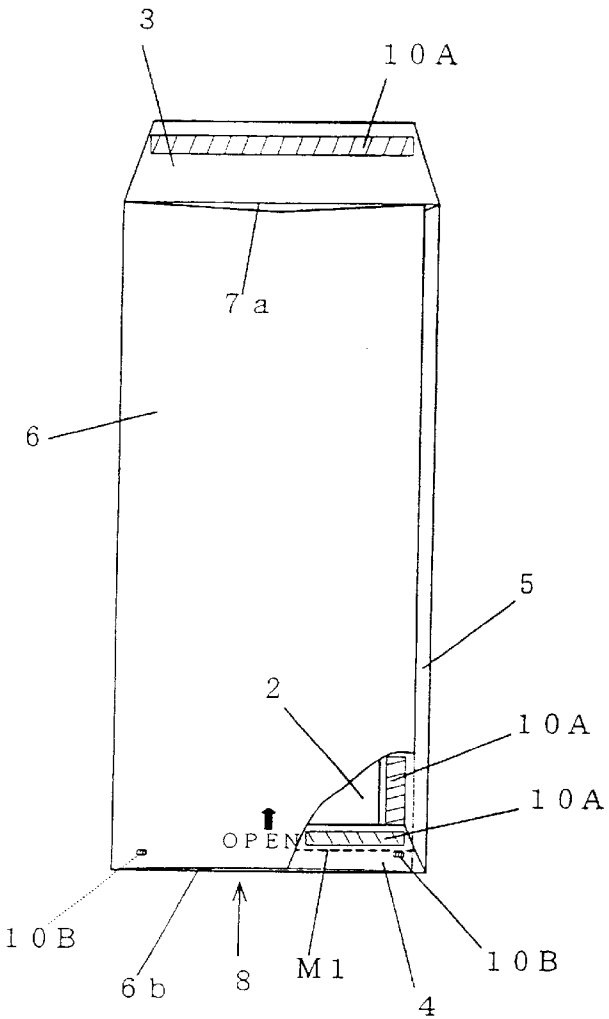
FIG. 20 is a rear view explaining the order of folding the blank of the above modification of sixth embodiment in FIG. 19.

A modification of the aforementioned embodiment will be described. As shown in FIG. 19 and FIG. 20, the opening 8 is disposed on the side (the lower side in the figures) opposite the side on which the postal code column is printed. Therefore, the outer peripheral flap 4 is formed in the lengthwise direction thereof with a perforation array M1 for opening. In addition, the lower side (outer peripheral end) 6*b* of the overlapping sheet 6 describes a gentle arc so that it is positioned inside the opening side of the center sheet 2 (a fold line 7*c*) and has an arrow mark printed at the center thereof. Though the upper side 6*a* of the overlapping sheet 6 also describes a gentle arc so that it is positioned inside the upper end of the center sheet 2, it may coincide with the upper end of the center sheet 2 because the upper end is not the opening side in this modification.

According to this modification, therefore, part of the envelope is cut off by pinching the opening side 6*b* with the fingers of one of the hands, pinching the outer peripheral end of the outer peripheral flap 4 with the fingers of the other hand and slightly pulling the pinched portions in the opposite directions, in the same manner as in the first embodiment, to open the envelope F1 in a clear-cut fashion.

(Seventh Embodiment)

Figure 21:
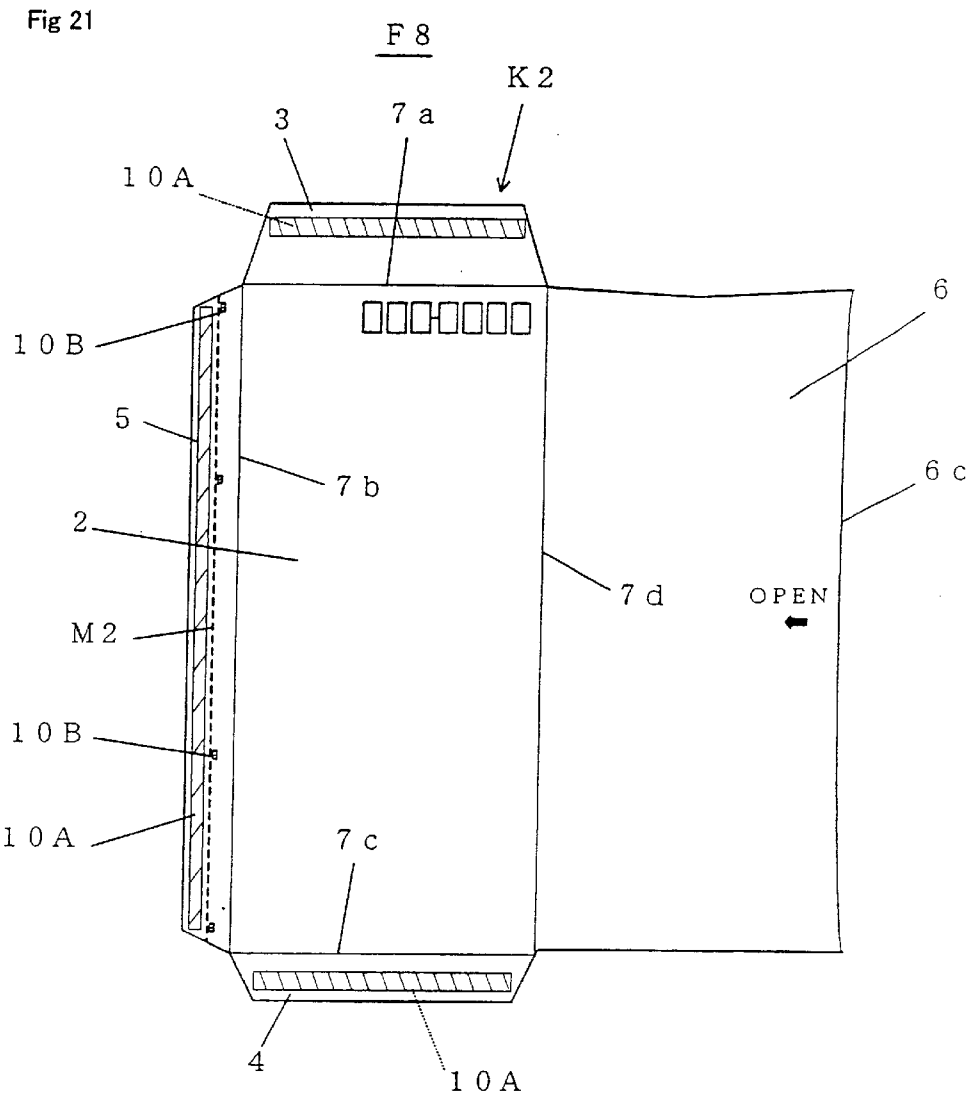
FIG. 21 is a front view showing a blank to be folded to form the envelope of the seventh embodiment.
Figure 22:
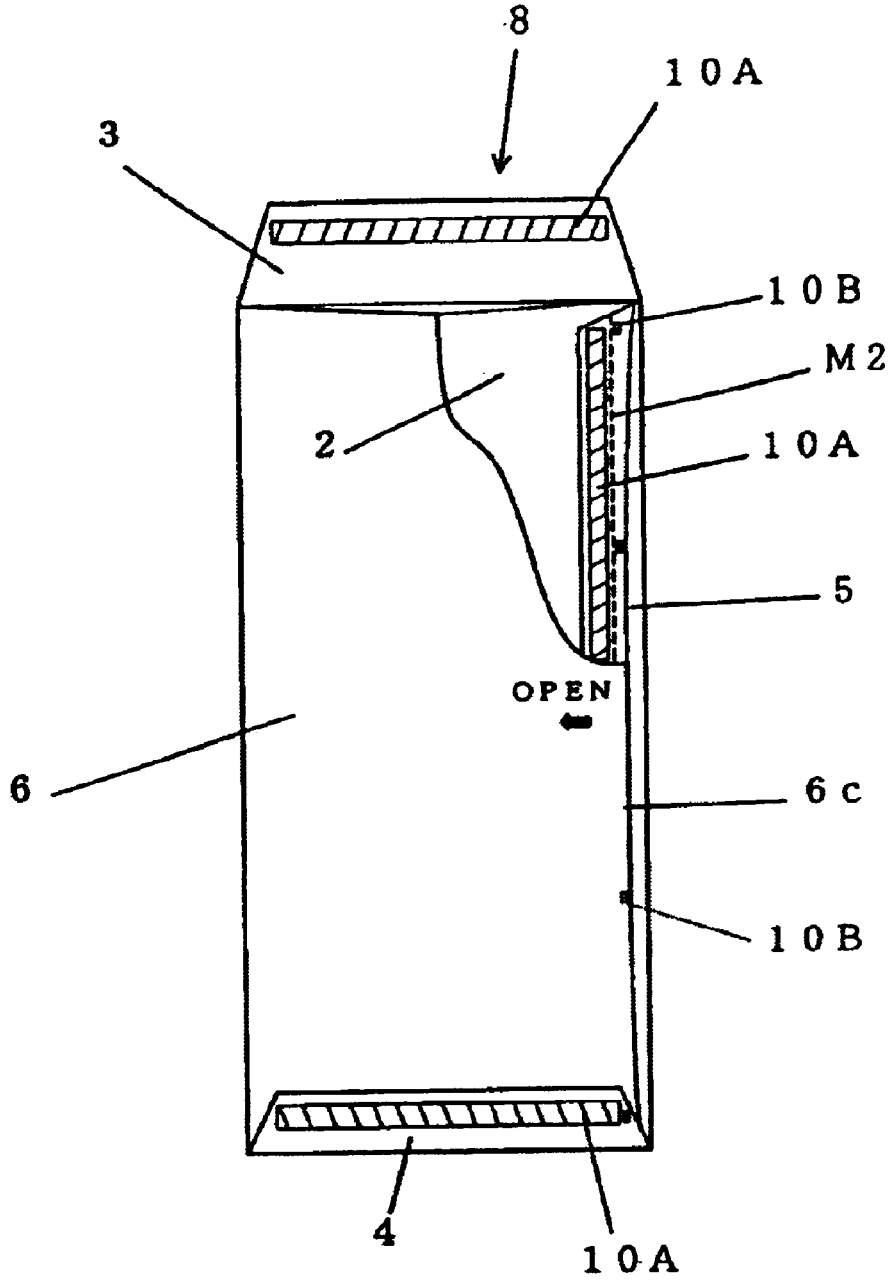
FIG. 22 is a rear view explaining the order of folding the blank of the seventh embodiment.

As shown in FIG. 21 and FIG. 22, this embodiment discloses an envelope F8, the contents of which are taken out of the longer side of the envelope F8. A developed blank K2 folded to form an envelope comprises a center sheet 2 provided with outer peripheral flaps 3, 4 and 5, and an overlapping sheet 6. While the outer peripheral flap 5 on the left side in the figure is formed with a perforation array M2 for opening, that extends in the lengthwise direction, the outer peripheral end 6*c* of the overlapping sheet 6 has an arrow mark serving as an opening criteria and a word "open" printed at the center in the lengthwise direction thereof. The outer peripheral end 6*c* of the overlapping sheet 6 describes a gentle arc to form a part that is located inside a fold line 7*b* for the outer peripheral flap 5, thereby forming a step between the part and the fold line 7*b* so that the outer peripheral end 6*c* of the overlapping sheet 6 can easily be pinched with the fingers.

When the blank is to be folded to form the envelope of this embodiment, the outer peripheral flap 5 is first folded down to the backside of the center sheet along the fold line 7*c*. The overlapping sheet 6 is then overlaid on and attached to the outer peripheral flap, and thereafter the outer peripheral flap 4 is overlaid on and attached to the overlapping sheet 6. This formation order is shown from FIG. 21 to FIG. 22. It is noted that it is possible to overlay the outer peripheral flap 4 on the folded outer peripheral flap 5 and overlay the overlapping sheet 6 on the overlaid outer peripheral flap. In this embodiment, therefore, part of the envelope is cut off along the perforation array M2 by pinching the outer peripheral end 6*c* with the fingers, pinching the outer peripheral end of the outer peripheral flap 5 with the fingers and slightly pulling the pinched portions in the opposite directions to open the envelope F8 in a clear-cut fashion. The remaining constitution of this embodiment is the same as that of the sixth embodiment.

It is possible to combine the constitution of this embodiment with the constitution of the modification of the sixth embodiment into an envelope. To be specific, the outer peripheral flap 4 is formed with a perforation array M2 for opening (the perforation array M1 in the modification of the first embodiment) to form the letter L in conjunction with the perforation array M2 for opening with which the outer peripheral flap 5 is formed, and the flaps are folded in the order mentioned. According to the envelope thus formed by folding the flaps, since the perforation array M2 of the outer peripheral flap 5 is continuous to the perforation array M1 of the lower side outer peripheral flap 4, the envelope can be opened in an L-shaped fashion to enable the contents S to be extracted.

(Eighth Embodiment)

Figure 23:
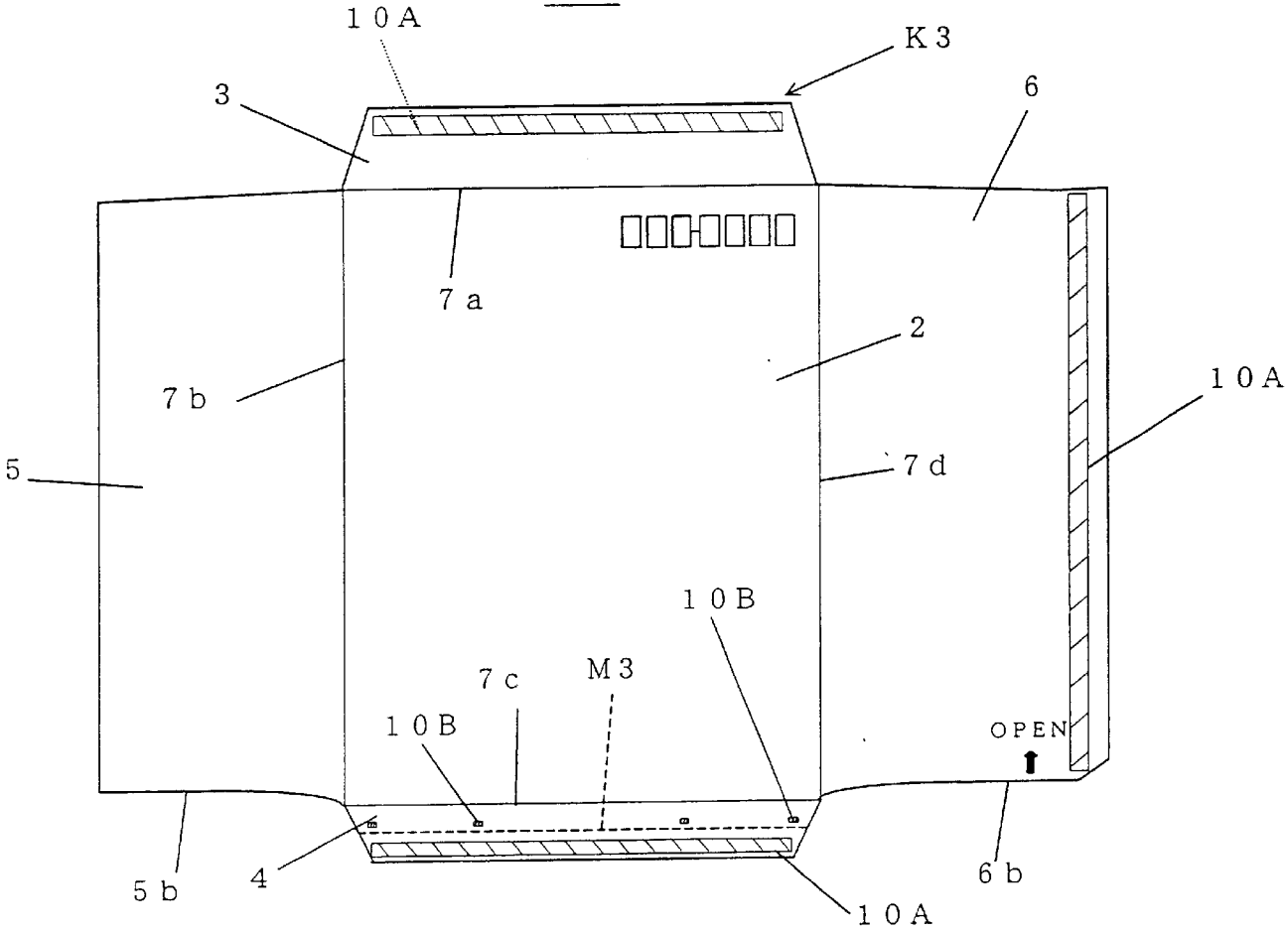
FIG. 23 is a front view showing a blank to be folded to form the envelope of the eighth embodiment according to the present invention.
Figure 24:
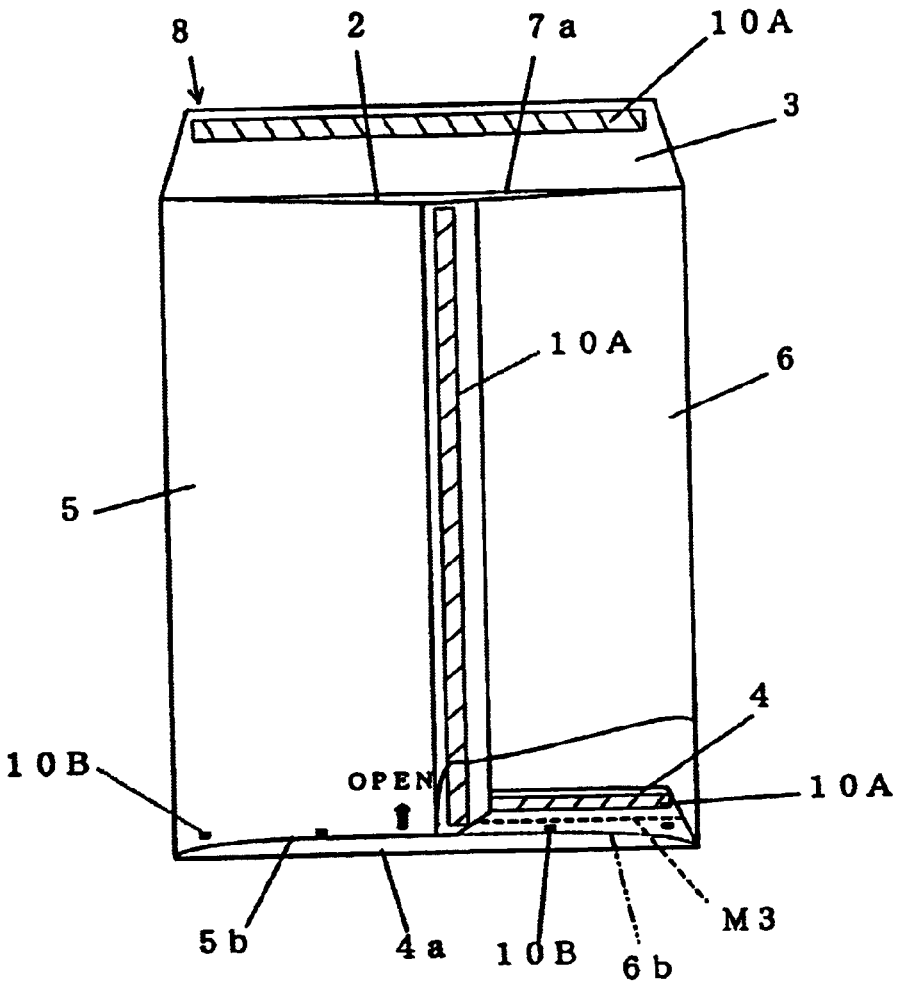
FIG. 24 is a rear view explaining the order of folding the blank of the eighth embodiment.

As shown in FIG. 23 and FIG. 24, this embodiment applies the present invention to a rectangular shaped envelope F9. A developed blank K3 folded to form an envelope comprises a center sheet 2 provided with outer peripheral flaps 3, 4 and 5 and an overlapping sheet 6. The outer peripheral flap 5 and overlapping sheet 6 are overlapped at the center of the back wall of the envelope F9. The outer peripheral flap 4 on the bottom side is formed with an array of perforations M3 in the lengthwise direction thereof. An outer peripheral end 6*b* of the overlapping sheet 6 adjacent to the outer peripheral flap 4 is formed to be disposed inward of a fold line 7*c* of the outer peripheral flap. Similarly, an outer peripheral end 15*b* of the outer peripheral flap 5 adjacent to the outer peripheral flap 4 is formed to be disposed inward of the fold line 7*c*. In this embodiment, since the outer peripheral flap 5 and overlapping sheet 6 are overlapped at the center of the back wall of the envelope F9, it is noted that the positions of the two flaps may have a reverse relationship.

The envelope of this embodiment is formed, as shown in FIG. 24, by folding the outer peripheral flap 4 back on the back wall along the fold line 7*c*, overlapping the outer peripheral flap 5 and overlapping sheet 6 at the center of the back wall and attaching the overlapped flaps. The envelope F9 of this embodiment thus formed by folding can be opened in a clear-cut fashion along the perforation array M3, in the same manner as in the sixth and seventh embodiments, by pinching an outer peripheral end 4*a* of the outer peripheral flap 4 with fingers, pinching the overlapped outer peripheral flap 5 and overlapping sheet 6 with fingers, and slightly pulling the pinched portions in the opposite directions. The remaining constitution of this embodiment is the same as that of the sixth embodiment.

(Ninth Embodiment)

Figure 26:
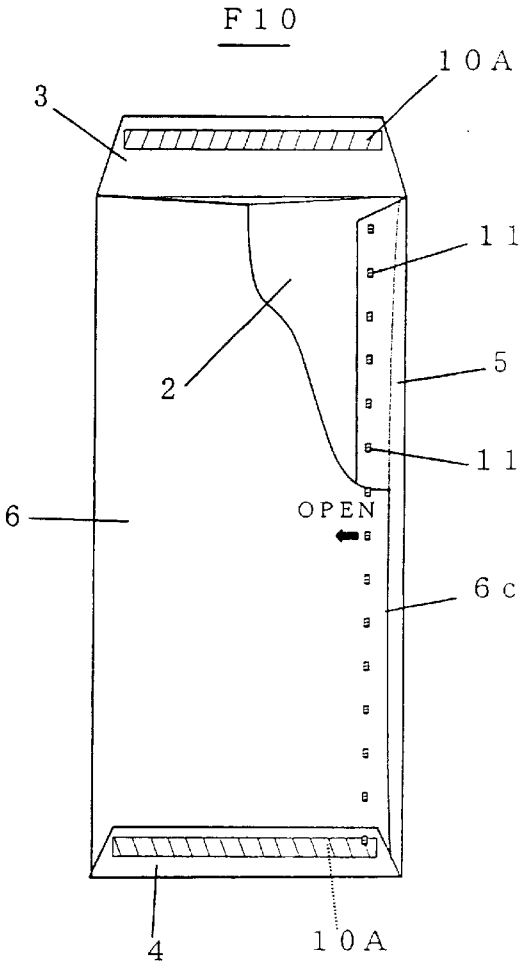
FIG. 26 is a rear view explaining the order of folding the blank of the ninth embodiment.
Figure 25:
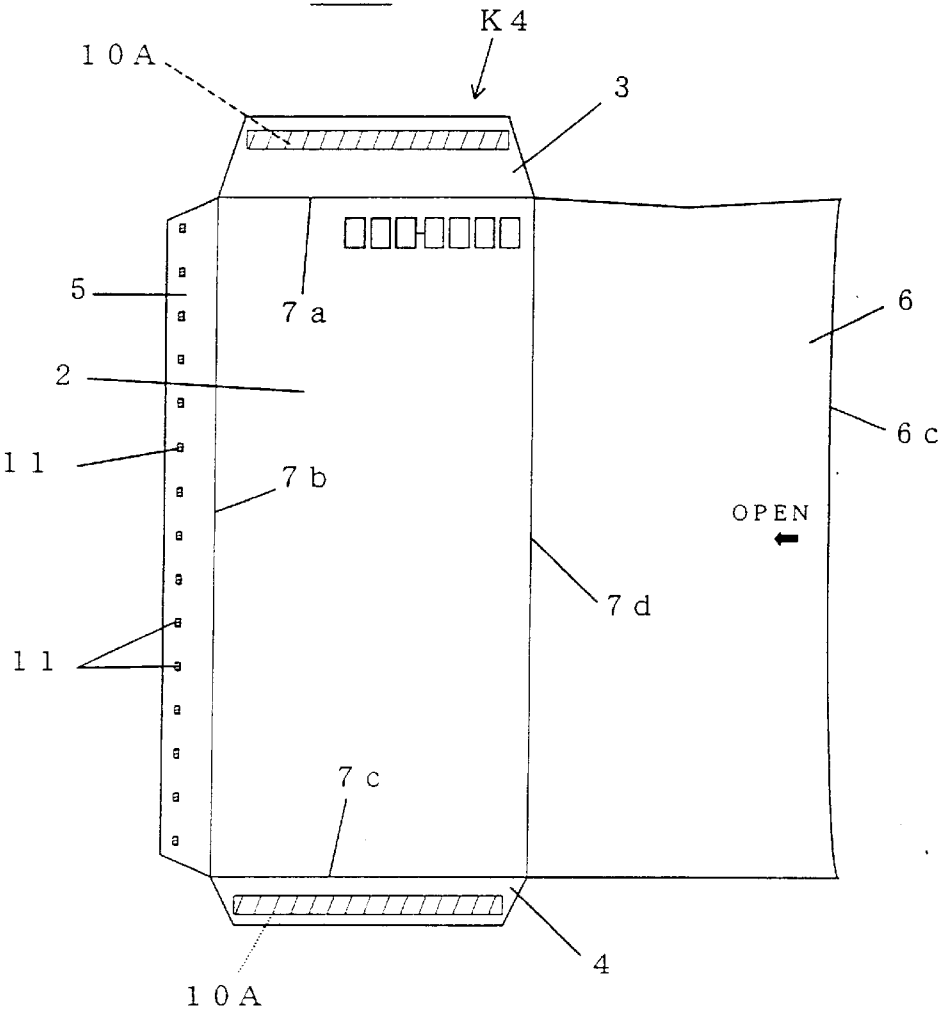
FIG. 25 is a front view showing a blank to be folded to form the envelope of the ninth embodiment according to the present invention.

As shown in FIG. 25 and FIG. 26, this embodiment applies the present invention to a paper envelope (called rectangular No. 3 or rectangular No. 4) F10. A developed blank T4 to be folded to form an envelope comprises a center sheet 2 provided with outer peripheral flaps 3, 4 and 5 folded back and an overlapping sheet 6 overlaid on the outer peripheral flaps 3, 4 and 5. It is folded to form an envelope, similarly to each of the preceding embodiments, provided that none of the perforation arrays M1, M2 and M3 formed in the preceding embodiments is formed. The overlapping sheet 6 is overlaid on the folded back outer peripheral flap 3, and the flaps 3 and 6 are attached to each other at predetermined intervals. The attached portions are indicated by reference numeral 11. To be specific, an adhesive such as paste etc. is applied to the outer peripheral flap 3 in the lengthwise direction, and the overlapping sheet 6 is attached to the outer peripheral flap 3 at the predetermined intervals. Various patterns of attachment between the outer peripheral flap 3 and the overlapping sheet 6 are conceivable, such as in the form of dispersed dot application of an adhesive such as paste etc., partial application thereof and application thereof at varying intervals. The remaining constitution of this embodiment is the same as that of the first embodiment and is omitted from the description. However, adhesive spots 10B for preventing the outer peripheral flap 3 from being spread outward from the overlapping sheet 6 may be provided at predetermined intervals.

Although this embodiment is provided with none of the perforation arrays M1, M2 and M3 (the perforation array M1 of the outer peripheral flap 3 in the first embodiment), since the outer peripheral flap 3 and overlapping sheet 6 are attached to each other at the predetermined intervals, the attached portions function like one of the perforation arrays M1, M2 and M3. A receiver who receives the envelope F4 pinches both predetermined portions of the outer peripheral flap 3 and overlapping sheet 6 with his/her fingers and pulling the pinched portions in the opposite directions, or otherwise, inserts a writing instrument such as a ball-pointed pen between the outer peripheral flap 3 and the overlapping sheet 6 and moves the writing instrument, with the result that the attached portions are cut off to enable easy and infallible opening of the envelope.

What is claimed is:

1. An envelope for enclosing a letter, comprising:

a center sheet having a rectangular shape defined by two short sides and two long sides;

a first peripheral flap that is folded back on one of the short sides of the center sheet so as to overlay the center sheet;

an overlapping sheet that is folded back on one of the long sides of the center sheet so as to overlay the center sheet and to adhesively overlay the first peripheral flap, thereby forming an envelope opening along another one of the long sides of the center sheet for receiving the letter; and an array of perforations formed on the first peripheral flap, and being substantially parallel and adjacent to a fold line formed between the first peripheral flap and the one short side of the center sheet, the perforations dividing the first peripheral flap into two sections, including a first portion that is adjacent to the fold line, and a second portion on another side of the perforations, the perforations being covered by the overlapping sheet, wherein the envelope is opened by pulling the overlapping sheet away from the first peripheral flap, thereby tearing the first peripheral flap at the array of perforations to allow the letter to be removed from the envelope by way of the one short side; and wherein after the envelope is opened, the overlapping sheet continues to overlay the center sheet, the first portion of the first peripheral flap remains folded inside the envelope, and the second portion of the first peripheral flap remains adhered to said overlapping sheet.

2. The envelope as claimed in claim 1, wherein the array of perforations is linear.

3. The envelope as claimed in claim 1, further comprising a second peripheral flap that is folded back on another one of the short sides of the center sheet so as to overlay the center sheet and to be adhesively overlaid by the overlapping sheet.

4. The envelope as claimed in claim 1, further comprising a third peripheral flap that is folded back on another one of the long sides of the center sheet so as to overlay the center sheet and to adhesively overlay the overlapping sheet to close the envelope.

5. The envelope as claimed in claim 1, wherein an adhesive is formed on the first peripheral flap for adhering the overlapping sheet to the first peripheral flap, the adhesive being located between the array of perforations and a distal edge of the first peripheral flap.

6. The envelope for enclosing a letter as claimed in claim 1, wherein the overlapping sheet has one short side overlaying the first peripheral flap, and which has an edge that is arced inwardly.

7. An envelope for enclosing a letter, comprising:

a center sheet having a rectangular shape defined by two short sides and two long sides;

a first peripheral flap that is folded back on one of the short sides of the center sheet so as to overlay the center sheet;

an overlapping sheet that is folded back on one of the long sides of the center sheet so as to overlay the center sheet and to adhesively overlay the first peripheral flap, thereby forming an envelope opening along another one of the long sides of the center sheet for receiving the letter; and an array of perforations formed on the first peripheral flap and covered by the overlapping sheet, wherein the envelope is opened by pulling the overlapping sheet away from the first peripheral flap, thereby tearing the first peripheral flap at the array of perforations, wherein an adhesive is formed on the first peripheral flap for adhering the overlapping sheet to the first peripheral flap, the adhesive being located between the array of perforations and a distal edge of the first peripheral flap, and wherein at least one adhesive spot is formed on the first peripheral flap and between the array of perforations and the one short side of the center sheet.

8. A blank folded to form an envelope, the blank comprising:

a center sheet having a rectangular shape defined by two short sides and two long sides;

a first peripheral flap extending from one of the short sides of the center sheet;

a second peripheral flap extending from another one of the short sides of the center sheet;

an overlapping sheet extending from another one of the long sides of the center sheet; and an array of perforations formed on the first peripheral flap, and being substantially parallel and adjacent to a fold line formed between the first peripheral flap and the one short side of the center sheet, the perforations dividing the first peripheral flap into two sections, including a first portion that is adjacent to the fold line, and a second portion on another side of the perforations, wherein the envelope is formed by folding back the first and the second peripheral flaps to overlay the center sheet and folding back the overlapping sheet to overlay the center sheet and to adhesively overlay at least the first peripheral flap so as to cover the array of perforations.

9. The blank as claimed in claim 8, wherein the array of perforations is linear.

10. The blank as claimed in claim 8, further comprising a third peripheral flap extending from one of the long sides of the center sheet.

11. The blank as claimed in claim 8, wherein an adhesive is formed on the first peripheral flap for adhering the overlapping sheet to the first peripheral flap, the adhesive being located between the array of perforations and a distal edge of the first peripheral flap.

12. The blank folded to form an envelope as claimed in claim 8, wherein the overlapping sheet has one short side overlaying the first peripheral flap, and which has an edge that is arced inwardly.

13. A blank folded to form an envelope, the blank comprising:

a center sheet having a rectangular shape defined by two short sides and two long sides;

a first peripheral flap extending from one of the short sides of the center sheet;

a second peripheral flap extending from another one of the short sides of the center sheet;

an overlapping sheet extending from another one of the long sides of the center sheet; and an array of perforations formed on the first peripheral flap, wherein the envelope is formed by folding back the first and the second peripheral flaps to overlay the center sheet and folding back the overlapping sheet to overlay the center sheet and to adhesively overlay at least the first peripheral flap so as to cover the array of perforations, wherein an adhesive is formed on the first peripheral flap for adhering the overlapping sheet to the first peripheral flap, the adhesive being located between the array of perforations and a distal edge of the first peripheral flap, and wherein at least one adhesive spot is formed on the first peripheral flap and between the array of perforations and the one short side of the center sheet.

* * * * *